US007739825B2

(12) United States Patent
LoRocco

(10) Patent No.: US 7,739,825 B2
(45) Date of Patent: Jun. 22, 2010

(54) ILLUMINATED SIGHTING DEVICE

(75) Inventor: Paul LoRocco, Dallas, TX (US)

(73) Assignee: TruGlo, Inc., Richardson, TX (US)

( * ) Notice: Subject to any disclaimer, the term of this patent is extended or adjusted under 35 U.S.C. 154(b) by 1183 days.

(21) Appl. No.: 11/307,244

(22) Filed: Jan. 27, 2006

(65) Prior Publication Data

US 2009/0199418 A1 Aug. 13, 2009

(51) Int. Cl.
*F41G 1/00* (2006.01)

(52) U.S. Cl. ..... 42/132; 42/111; 42/123; 33/265

(58) Field of Classification Search ..... 42/111, 42/123, 132; 33/265
See application file for complete search history.

(56) References Cited

U.S. PATENT DOCUMENTS

| | | | | | |
|---|---|---|---|---|---|
| 696,962 | A | * | 4/1902 | Hamilton | 42/111 |
| 939,085 | A | * | 11/1909 | Mauser | 42/111 |
| 1,004,180 | A | * | 9/1911 | Powell | 42/111 |
| 2,529,057 | A | * | 11/1950 | Teffault | 42/132 |
| 5,519,941 | A | | 5/1996 | Yusko | |
| 5,784,182 | A | | 7/1998 | Francoeur et al. | |
| 5,850,700 | A | * | 12/1998 | Capson et al. | 33/265 |
| 5,924,234 | A | | 7/1999 | Bindon et al. | |
| 6,035,539 | A | * | 3/2000 | Hollenbach et al. | 42/132 |
| 6,068,483 | A | * | 5/2000 | Minor | 434/19 |
| 6,199,286 | B1 | * | 3/2001 | Reed et al. | 33/265 |
| 6,418,633 | B1 | | 7/2002 | Rager | |
| 6,477,778 | B1 | | 11/2002 | Lorocco | |
| 6,601,308 | B2 | * | 8/2003 | Khoshnood | 33/265 |
| 6,725,854 | B1 | * | 4/2004 | Afshari | 124/87 |
| 6,807,742 | B2 | * | 10/2004 | Schick et al. | 33/297 |
| 7,210,261 | B2 | * | 5/2007 | Arachequesne | 42/111 |
| RE39,686 | E | * | 6/2007 | Khoshnood | 33/265 |
| 7,308,891 | B2 | * | 12/2007 | Graf | 124/87 |
| 2003/0121163 | A1 | * | 7/2003 | Khoshnood | 33/265 |
| 2004/0047586 | A1 | * | 3/2004 | Schick et al. | 385/147 |
| 2005/0138824 | A1 | * | 6/2005 | Afshari | 33/265 |
| 2009/0100735 | A1 | * | 4/2009 | Schick et al. | 42/123 |

* cited by examiner

*Primary Examiner*—Troy Chambers
*Assistant Examiner*—Samir Abdosh
(74) *Attorney, Agent, or Firm*—Alvin R. Wirthlin

(57) ABSTRACT

An illuminated sighting device includes an elongate light collector having one end defining a sight point that faces rearwardly for viewing by a user. The light collector is formed such that light can be gathered along its length and transmitted to the one end. The light collector further includes a curved transition section optically coupled with the sight point. The curved transition section has a radius of curvature that is sufficiently large to substantially reduce or eliminate light loss from the curved section and thereby increase a brightness of the sight point.

23 Claims, 21 Drawing Sheets

ILLUMINATED SIGHTING DEVICE

BACKGROUND OF THE INVENTION

This invention relates generally to sighting devices for firearms, archery bows, or other projectile launching devices, and more particularly to a front sight for a firearm that is illuminated with a light collector, such as a fluorescent-doped fiber optic.

Sighting devices using short segments of light gathering fiber optics, such as scintillating or fluorescent-doped fiber optics, are currently in use. Such fiber optics gather ambient light along their length and transmit that light to their ends. Under ideal lighting conditions, one end of the fiber optic typically serves as a bright aiming point, the brightness being directly dependent on the level of ambient light incident on the length of fiber optic. However, the short segments of fiber optic have a limited light gathering ability. Under very low lighting conditions, such as at late dusk or early dawn, the sight point may not have sufficient brightness to satisfy some users. In order to augment the brightness of the sight point under these conditions, artificial light sources such as battery-operated LED's or tritium-type devices have been proposed.

As an alternative to such devices, the fiber optic may be coiled to increase the light gathering length of the fiber optic, and thus the brightness of the sight point. However, such a prior art arrangement typically includes a sharp transition or bend between the coiled section and a section of the fiber optic mounted to a sight pin. Light loss at the sharp bend results in an inefficient transfer of light from the coil section to the sight point, requiring a longer length of fiber optic to illuminate a sight point with less than anticipated brightness. It would therefore be desirable to provide a self-illuminating sighting device that overcomes at least some of the disadvantages of the prior art.

BRIEF SUMMARY OF THE INVENTION

According to one aspect of the invention, an illuminated sighting device includes an elongate light collector having one end defining a sight point that faces rearwardly for view by a user. The light collector is formed such that light can be gathered along its length and transmitted to the one end. The light collector further includes a curved transition section optically coupled with the sight point and a coiled section that extends from the curved section. The coiled section spirals around at least a portion of the curved section. The curved section has a radius of curvature that is sufficiently large to substantially reduce or eliminate light loss from the curved section and thereby increase a brightness of the sight point.

According to a further aspect of the invention, a sight for a firearm includes a spool defining a sight window, a sight post extending into the sight window, a mounting base connected to the spool for connecting the sight to the barrel, and an elongate light collector with opposite ends, at least one end thereof connected to the sight post. The at least one end of the light collector has at least one rearwardly facing sight point for view by a user. The light collector is formed such that light can be gathered along its length and transmitted to the at least one end.

According to yet a further aspect of the invention, a sight for a projectile launching device includes a spool, a sight post extending from the spool, and an elongate light collector having opposite ends with at least one end connected to the sight post to define a rearwardly facing sight point for viewing by a user. The light collector is formed such that light can be gathered along its length and transmitted to the at least one end.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
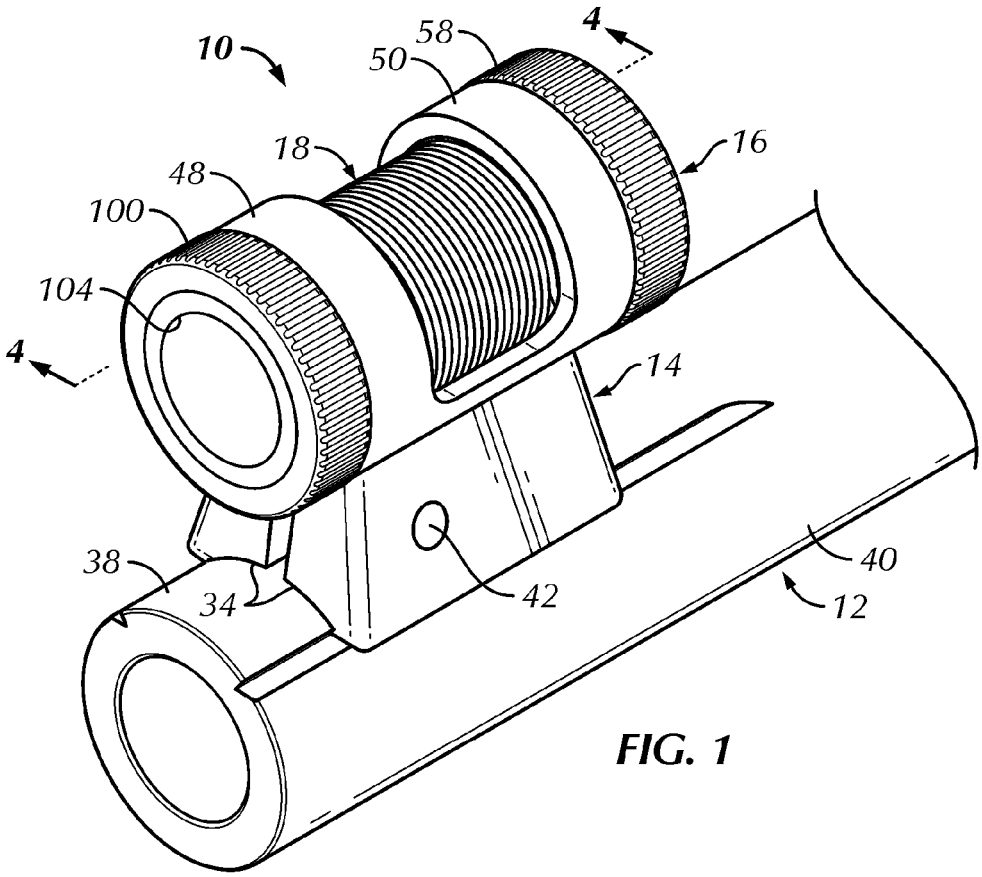
FIG. 1 is a front perspective view of an illuminated sight mounted to a forward end of a barrel of a firearm in accordance with one embodiment of the present invention.

Referring to the drawings, and to FIG. 1 in particular, an illuminated sight 10 in accordance with the present invention is illustrated. The sight 10 is preferably adapted for use with a particular projectile launching device 12 such as a rifle, pellet gun, BB gun, pistol, bow, or the like. To this end, the sight 10 is provided with a mounting base 14 for attachment to the projectile launching device 12. It will be understood that the term "mounting base" as used throughout the specification includes any arrangement or structure for connecting the sight to a projectile launching device. However, it will be understood that the sight 10 can be used with other devices, such as telescopes, sighting scopes, and so on, in order to quickly align the device with a distal target or scene. The sight 10 further includes a spool 16 connected to the mounting base 14 and a light collector 18 that wraps around the spool 16.

Figure 2:
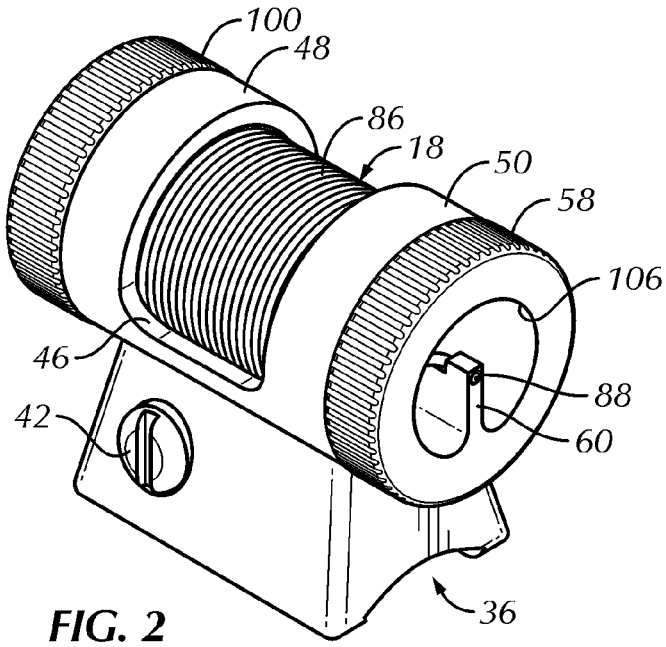
FIG. 2 is a rear perspective view of the sight of FIG. 1.
Figure 3:
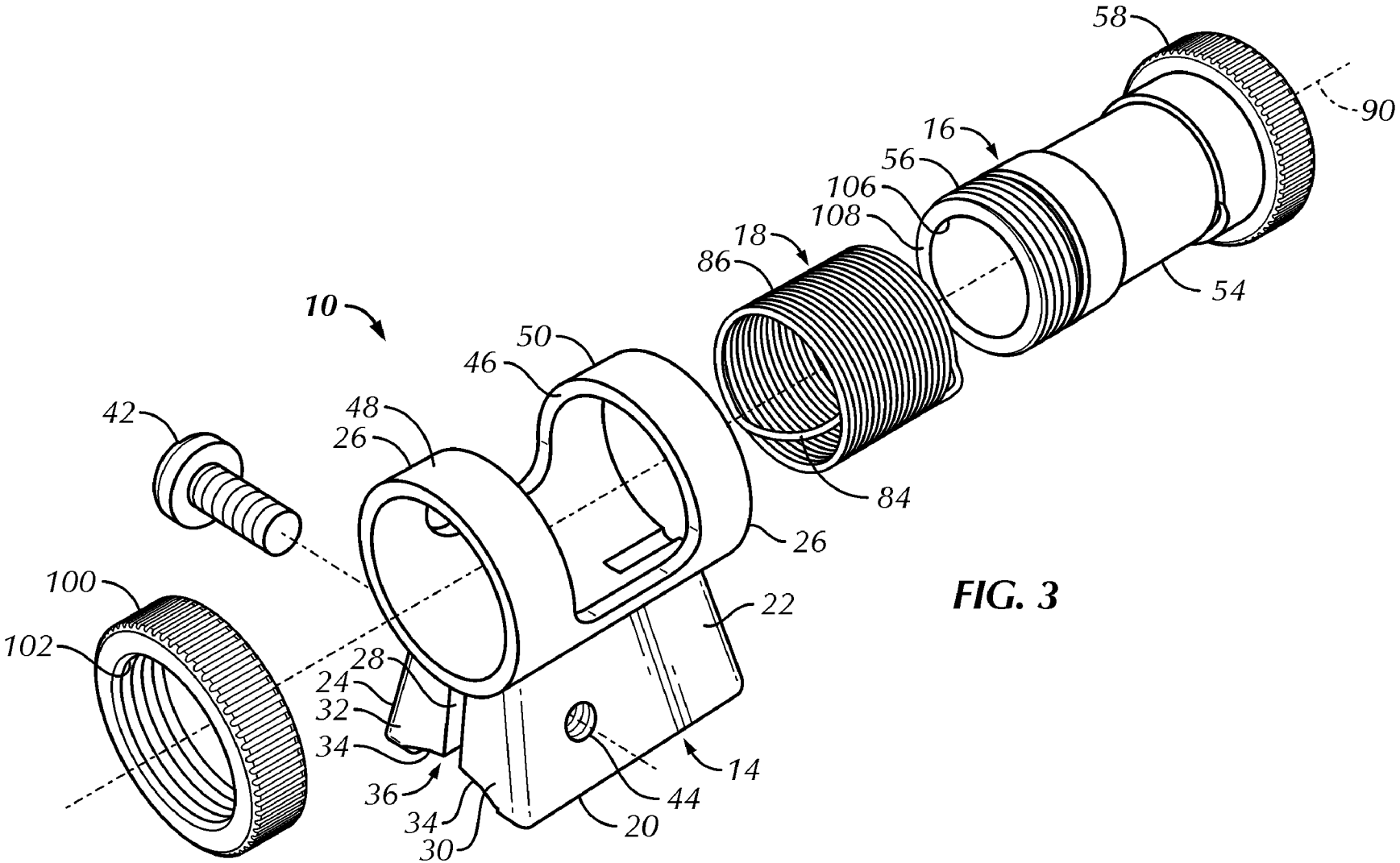
FIG. 3 is an exploded front perspective view of the sight of FIG. 1.
Figure 4:
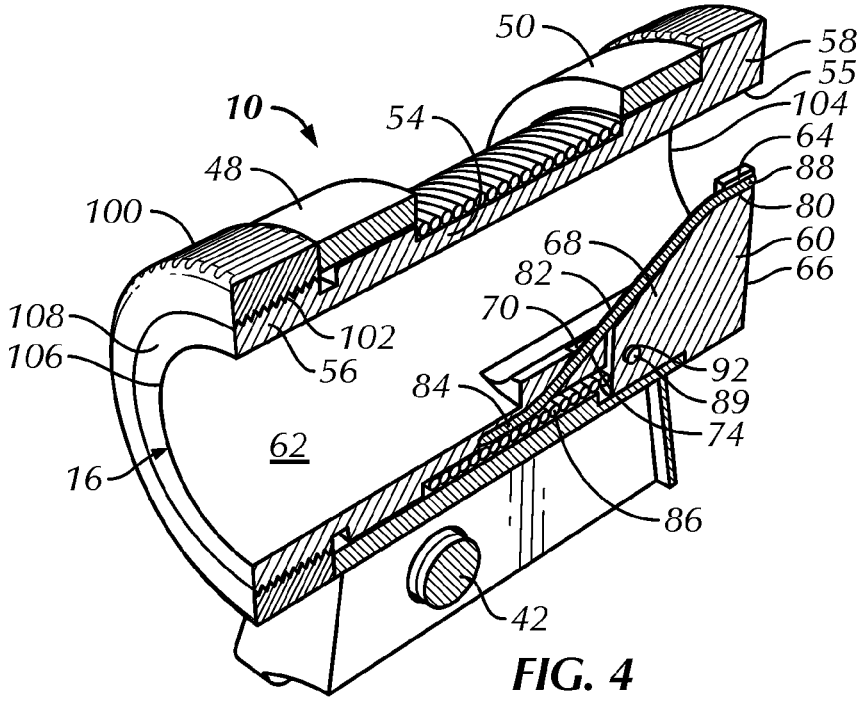
FIG. 4 is a front perspective sectional view of the sight taken along line 4-4 of FIG. 1.

With additional reference to FIGS. 2-4, the mounting base 14 preferably includes a bifurcated leg 20 of truncated triangular shape with side surfaces 22, 24 that converge toward a collar 26. A slot 28 extends longitudinally through the leg 20 to define bifurcated leg portions 30, 32. The leg portions 30, 32 have a lower surface 34 that together form a dovetail-shaped groove 36 for receiving a complementary dovetail-shaped projection 38 (FIG. 1) associated with the barrel 40 of a firearm 12 or the like. A threaded bolt 42 extends through an opening (not shown) in the leg portion 32 and engages a threaded opening 44 in the leg portion 30 to pull the leg portions toward each other for securely mounting the base 14 to the firearm. The collar 26 includes an opening or window 46 that separates collar portions 48 and 50. When assembled, the coiled section 86 of the light collector 18 is in alignment with the window 46. To that end, the window 46 is preferably shaped to maximize exposure of the light collector to ambient light.

Figure 5:
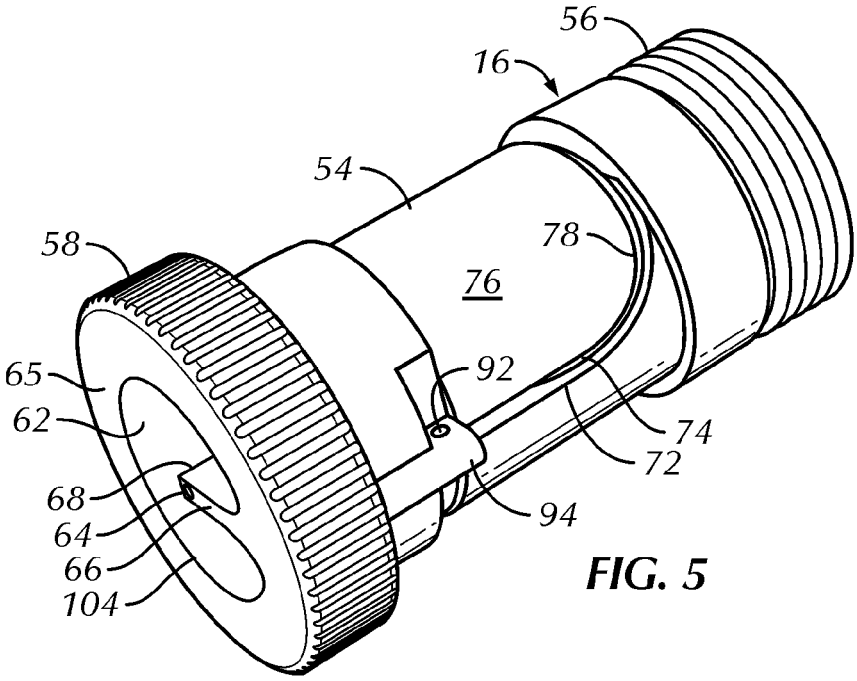
FIG. 5 is a bottom perspective rear view of a spool that forms part of the sight of FIG. 1.

As shown most clearly in FIGS. 3, 4 and 5, the spool 16 is preferably of a tubular configuration and generally circular in cross section. The spool 16 has a continuous wall 55 with an annular channel 54 around which the coiled section 86 of the light collector 18 is wrapped. The spool also has a threaded portion 56 located rearwardly of the annular channel and a knurled portion 58 located forwardly of the annular channel. A sight post 60 projects radially inwardly from an inner surface 62 of the spool 16 and includes a bore 64 that is preferably coincident with a central axis 90 of the spool 16 and a first ramped portion 68 that slopes toward the bore 64. As shown, the sight post 60 is oriented generally vertically. However, it will be understood that the sight post may have a horizontal orientation or any other angular orientation. An opening 70 extends between the inner surface 62 of the spool 16 and an outer surface 76 of the annular channel 54. A slot or groove 72 is formed in the outer surface 76 of the annular channel 54 and communicates with the opening 70. The slot 72 has a second ramped portion 74 that slopes toward the first ramped portion 68 from a curved section 78 of the slot. Preferably, the first and second ramped portions have similar slopes. Although not necessary, the rear surface 66 of the sight post 60 may be flush with the rear surface 65 of the knurled portion 58. Preferably, the spool 16, sight post 60 and knurled portion 58 are constructed as a unitary structure through injection molding, machining or the like. However, it will be understood that these components may be formed separately and connected together through bonding, welding, press-fitting or other connecting means.

Figure 6:
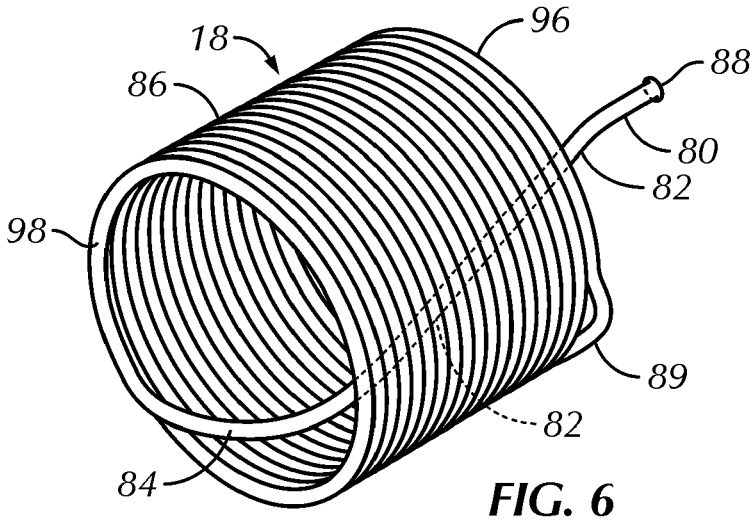
FIG. 6 is a front perspective view of a light collector that forms part of the sight of FIG. 1.

Referring to FIGS. 3, 4 and 6, the light collector 18 is preferably constructed of a fluorescent-doped fiber optic or the like. A suitable fluorescent-doped fiber optic may be constructed of a polystyrene-based core containing one or more fluorescent dopants that is surrounded by a polystyrene, polymethyl methacrylate, or fluoropolymer cladding. When such a fiber optic receives radiation along its length, energy is absorbed in the fiber optic at a certain wavelength and is re-emitted at both ends of the fiber optic at a longer wavelength. Thus, depending on the amount of radiation absorbed by the fiber optic along its length, a proportionate amount of radiation is emitted at the ends of the fiber optic. Although the fiber optic is preferably circular in cross section, it is contemplated that other cross sectional shapes such as oval, triangular, rectangular, arcuate, etc., may be used. Moreover, it will be understood that the light collector 60 is not limited to the particular material as set forth in the exemplary embodiment. The core and cladding may be formed out of any suitable transparent or translucent materials, as long as the index of refraction of the core material is greater than the index of refraction of the cladding material. The cladding material itself may be air or other fluid surrounding at least a portion of the core, and so on.

The light collector 18 preferably includes a generally straight or axially oriented section 80, a first transition or ramped section 82 extending from the axial section 80 in a general radial direction, a second transition or curved section 84 extending from the first transition section 82, a coiled section 86 extending from the second transition section 84, and an anchoring section 89 extending from the coiled section 86. Although for the sake of economy it is preferred that the various sections or segments are continuous, that is to say formed of a single length of fluorescent-doped fiber optic, the sections can be formed of different materials. For example, the first and/or second mentioned sections can comprise a regular fiber optic or optical rod and the remaining sections can comprise a light gathering fiber optic that is optically coupled with the first and/or second mentioned sections so that light gathered along a length of the coiled section 86 can be transmitted to the sight point 88 of the axial section 80.

The axial section 80 extends through the bore 64 of the sight post 60 and terminates in a sight point 88 that faces rearwardly for viewing by a user. The first transition or ramped section 82 extends along the first ramped portion 68 of the sight post, through the opening 70, and along the second ramped portion 74 of the spool 16. Preferably, the ramped section 82 is located substantially rearward of the coiled section 86 so that the second transition or curved section 84 can have a relatively large radius of curvature to substantially reduce or eliminate light loss through the curved section. The second transition or curved section 84 is positioned in the slot 78 while the coiled section 86 wraps around the annular channel 54 of the spool 16 for a predetermined number of turns. Preferably, the coiled section 86 has a constant diameter along the central axis 90 (FIG. 3) of the spool 16. The particular number of turns in the coiled section 86 can vary and depends on the desired brightness of the sight point 88 as viewed by the user, the ambient light intensity, the cross sectional size and shape of the fiber optic, the fiber optic length, the fiber optic material, and the amount of fluorescent dopant present in the core. Although not shown, an artificial light source, such as a battery-powered LED, tritium light source, and so on, can be used to augment the brightness of the sight point 88 in very low light conditions.

The axial section 80 of the light collector 18 is preferably anchored to the sight post 60 by making a diameter or cross dimension of the sight point 88 larger than the diameter or cross dimension of the bore 64. Enlargement of the sight point 88 can be accomplished by applying heat to the rear end of the fiber optic either before or after the fiber optic has been inserted through the bore 64. The application of heat also advantageously forms a sight point with an integral lens on the rearward end of the axial section 80 so that light exiting the fiber optic is distributed over a wider field of view. Alternatively, the axial section 80 can be secured to the sight post 60 through adhesives, clamps, fasteners, heat staking, ultrasonic welding, or other connecting means.

The anchoring section 89 located at the forward end of the light collector 18 extends through a transverse bore 92 (FIG. 5) formed in a nub 94 of the spool 16. The nub 94 preferably extends between the knurled portion 58 and the slot 72 and is in longitudinal alignment with the slot. As with the axial section 80 at the rear end of the light collector, the anchoring section 89 is preferably anchored to the nub 94 by enlarging the anchoring end 89 through the application of heat once it has been inserted through the transverse bore 92. Alternatively, the anchoring section 89 can be secured to the spool 16 through other connecting means, as described above.

The curved section 84 of the light collector 18 preferably has a radius of curvature that is sufficiently large to eliminate or at least substantially reduce light loss from the light collector through the curved section. In this manner, the light collector 18 is more efficient in conducting the light received along its length to the sight point 88, resulting in a brighter sight point. The radius of curvature of the curved section 84 is preferably at least two times greater than the diameter of the light collector 18, and more preferably about four to six times greater. By way of example, it has been found that for a fluorescent-doped fiber optic having a diameter of 0.029 inch, a radius of curvature of about 0.177 inch eliminates light loss through the curved section. This arrangement is a great advantage over prior art solutions where a relatively tight bend is conducive to light loss. The larger radius of curvature of the present invention will result in a much brighter sight point 88 than a tight bend for the same length of fiber optic. Accordingly, a shorter length of fiber optic can be used to obtain a brightness similar to prior art solutions.

As best shown in FIG. 6, the axial section 80 and sight point 88 are positioned outside of the coiled section 86 while the ramped section 82 is positioned partially outside of the coiled section and the remaining portion of the ramped section together with the curved section 84 extend through the coiled section 86 from the rearward end 96 to the forward end 98 thereof. With this arrangement, sufficient space is provided for a curved section 84 with a large radius of curvature.

Referring to FIGS. 3-6, one exemplary method of assembling the illuminated sight 10 includes stringing a first end of the light collector 18 through the bore 64 of the sight post 60 and the second end through the opening 70 of the spool 16. The second end of the light collector is then pulled until the light collector rests on the first ramped portion 68 to form the ramped section 82. Heat can then be applied to the first end to thereby enlarge the sight point 88 and anchor the first end to the sight post 60. The light collector 18 is then positioned in the slot 72 (FIG. 5) to form the curved section 84 then wound around the annular channel 54 to form the coiled section 86. The slot 72 in the spool 16 is preferably dimensioned to receive the ramped section 82 and curved section 78 of the light collector 18 so that these sections are either flush with the outer surface 76 or below the outer surface of the annular channel 54. In this manner, the coiled section 86 can be wound directly on the outer surface 76 without interference from the ramped and curved sections of the light collector 18. Finally, the second end of the light collector is inserted through the transverse bore 92 and anchored in place by expanding the second end through the application of heat as previously described. The assembled spool 16 is then inserted through the collar portions 48, 50 of the mounting base 14 until the threaded portion 56 is exposed forwardly of the collar portion 48. A knurled ring 100 with internal threads 102 (FIG. 3) is then screwed onto the threaded portion 56 to secure the spool assembly to the mounting base. Although one exemplary method of assembling the illuminated sight 10 has been described, it will be understood that other assembly methods can be employed.

Figure 7A:
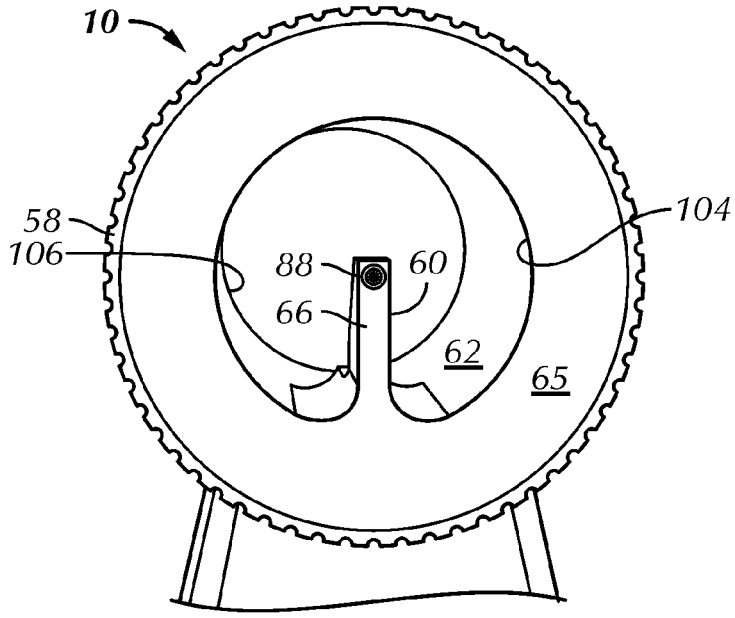
FIG. 7A is a rear view of the illuminated sight in a skewed position.
Figure 7B:
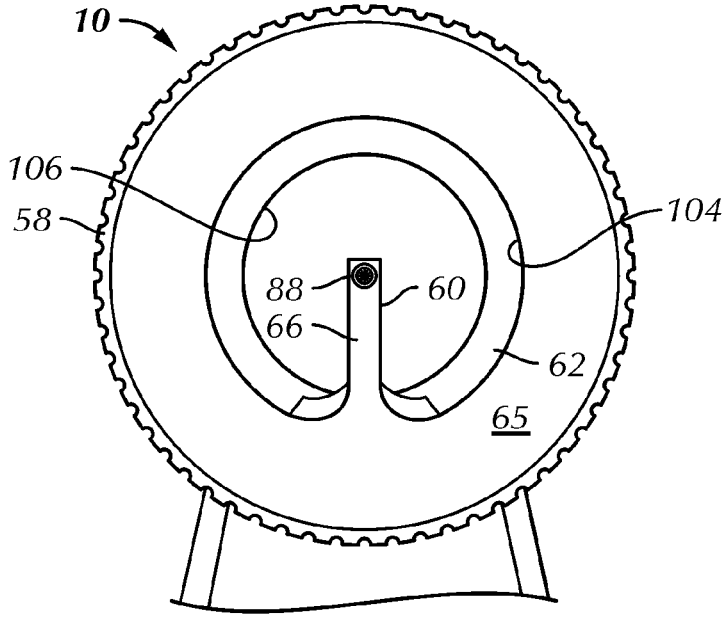
FIG. 7B is a rear view of the illuminated sight in an aligned position.

The above-described illuminated sight 10 is particularly useful as a front sight for a firearm and may function as both the front and rear sights to properly orient and aim the firearm, as shown in FIGS. 7A and 7B. The tubular nature of the spool 16 defines a sight window with a rear aperture ring or edge 104 at the intersection of the inner surface 62 of the spool 16 and the rear surface 65 of the knurled portion 58 and a perceived front aperture ring or edge 106 at the intersection of the inner surface 62 and the front surface 108 (FIG. 3) of the spool 16. In FIG. 7A, a user can readily discern by the perceived offset nature of the front and rear aperture rings 106, 104 that the sight 10, and thus the firearm, is not properly aligned with the user for aiming at a distal target. In FIG. 7B, the user can discern from the perceived concentric nature of the front and rear aperture rings 106, 104 that the firearm and user are properly aligned for superimposing the sight point 88 on a distal target. It will be understood that the front and rear aperture rings need not be closed circular shapes as illustrated, but may be embodied in a variety of different shapes and sizes, and may be either opened or closed.

In use, light incident on the coiled section 86 of the light collector 18 is absorbed in the fiber optic and is re-emitted at the sight point 88 and at the end of the anchoring section 89. In this manner, the sight point 88 is illuminated by the absorbed ambient light and can be more easily aligned with a desired distal target. Since, in this embodiment, light at the end of the anchoring section will not be used as a sight point, the end may be covered with a suitable light blocking coating or provided with a reflective surface to redirect the light to the sight point 88. However, it will be understood that both ends of the light collector 18 may be used as separate sight points.

Figure 8:
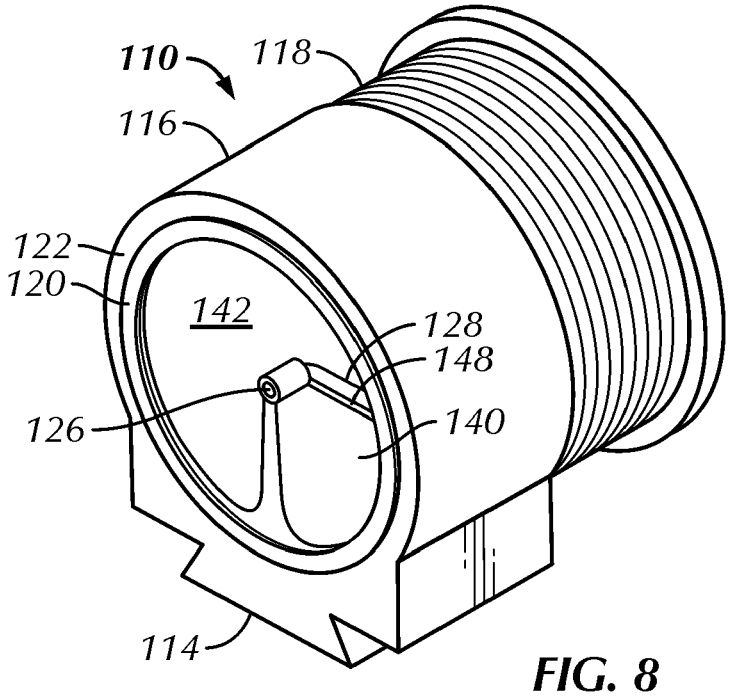
FIG. 8 is a rear perspective view of an illuminated sight in accordance with a further embodiment of the invention.
Figure 9:
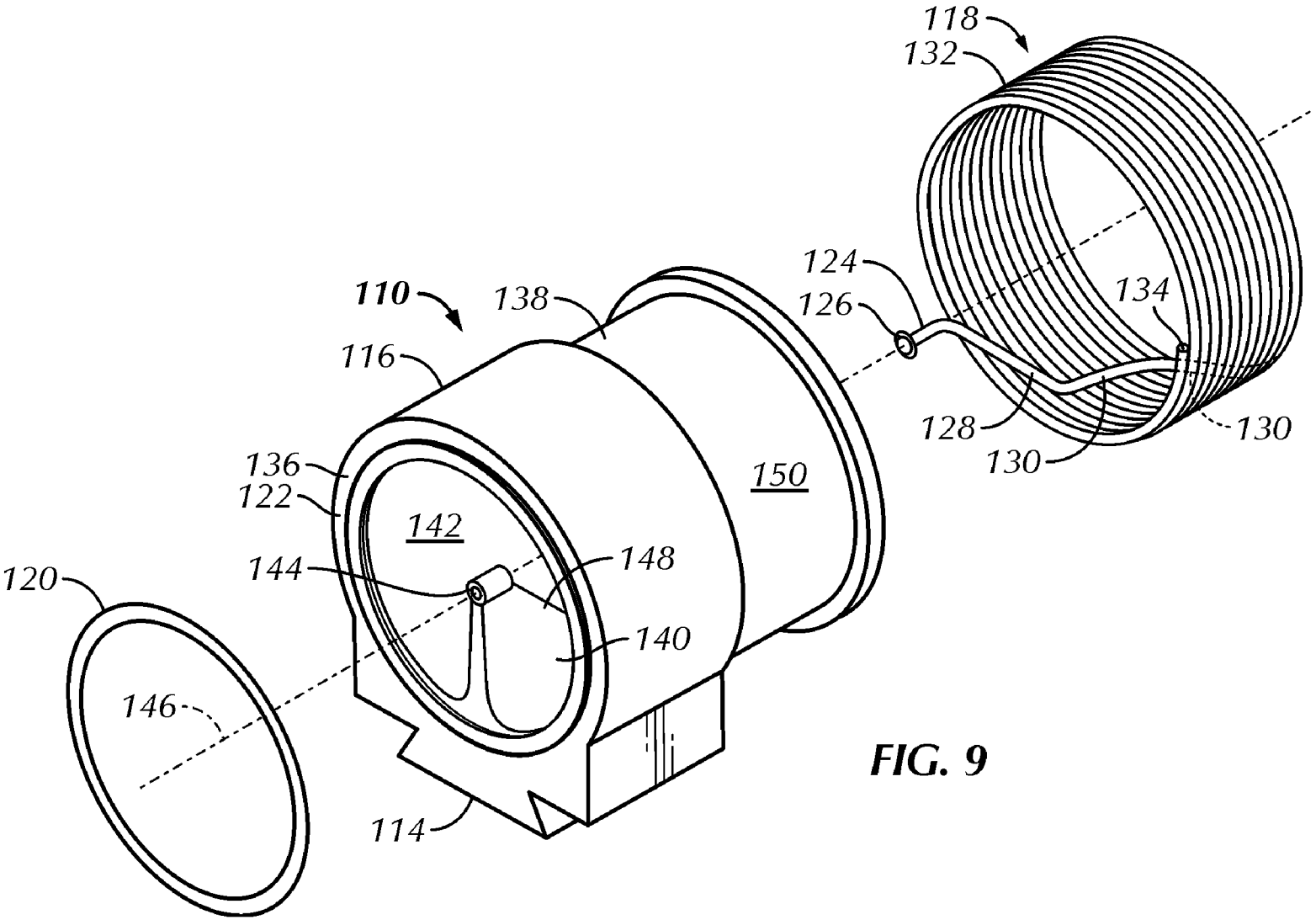
FIG. 9 is an exploded rear perspective view of the sight of FIG. 7.

Referring now to FIGS. 8 and 9, an illuminated sight 110 in accordance with a further embodiment of the invention is illustrated. The sight 110 preferably includes a dovetail-shaped mounting base 114, a spool 116 connected to the mounting base 114, a light collector 118 that wraps around the spool 116, and a luminous ring 120 connected to the rear face 122 of the spool. Preferably, the base 114 and spool 116 are constructed as a unitary structure through injection molding, machining or the like. However, it will be understood that these components may be formed separately and connected together through bonding, welding, press-fitting or other connecting means.

The light collector 118 is preferably similar in shape and construction to the light collector 18 previously described and includes a straight or axially oriented section 124 with an enlarged sight point 126, a first transition or ramped section 128 that extends from the axial section 124, a second transition or curved section 130 that extends from the ramped section 128, and a coiled section 132 that extends from the curved section 130. The end 134 of the coiled section 132 can be anchored to the spool 116 and/or the coiled section 132 through adhesive bonding or the like. Preferably, at least a substantial portion of the ramped section 128 is located rearwardly of the coiled section 132 so that the curved section 130 can have a relatively large radius of curvature to reduce or eliminate light loss through the curved section.

The spool 116 is preferably of a tubular configuration and generally circular in cross section. The spool 116 has a continuous wall 136 with an annular channel 138 around which the coiled section 132 of the light collector 118 is wrapped. A sight post 140 projects radially inwardly from an inner surface 142 of the spool 116 and includes a bore 144 that is preferably coincident with a central axis 146 of the spool 116 and a first ramped portion 148 that slopes toward the bore 144 from the inner surface 142. As shown, the sight post 140 is oriented generally vertically. However, it will be understood that the sight post may have a horizontal orientation or any other angular orientation. As in the previous embodiment, an opening (not shown) extends between the inner surface 142 of the spool 116 and an outer surface 150 of the annular channel 138. A curved slot or groove (not shown) is also formed in the outer surface 150 of the annular channel 138 and communicates with the opening for receiving the curved section 130 of the light collector 118 as previously described with respect to the illuminated sight 10. Preferably, the sight post 140 is formed as a unitary structure with the spool 116 and mounting base 114.

Figure 10:
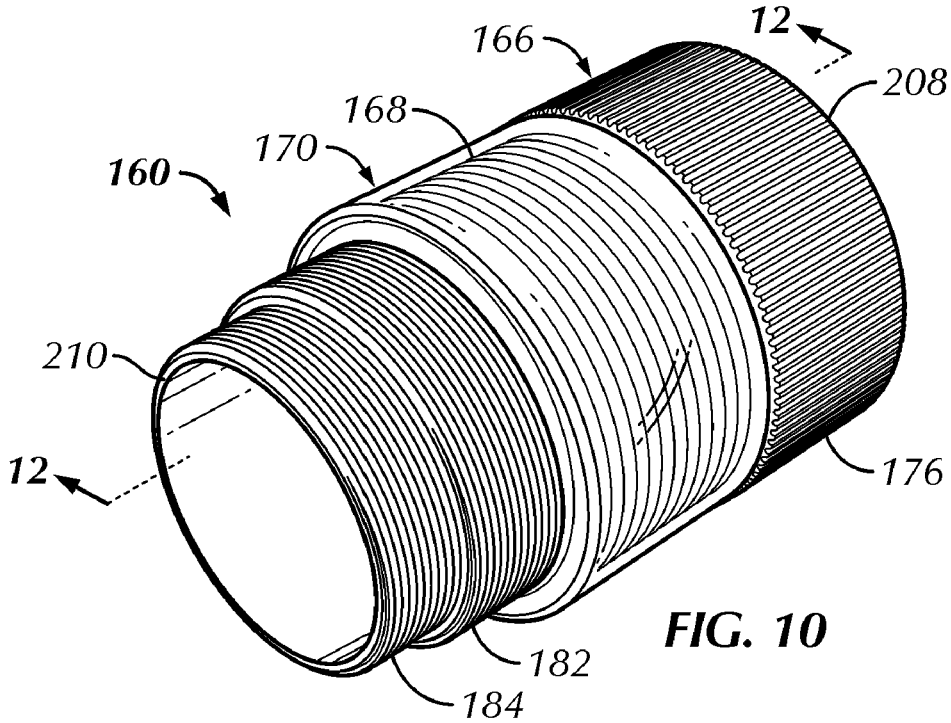
FIG. 10 is a front perspective view of an illuminated sight in accordance with yet a further embodiment of the invention.
Figure 12:
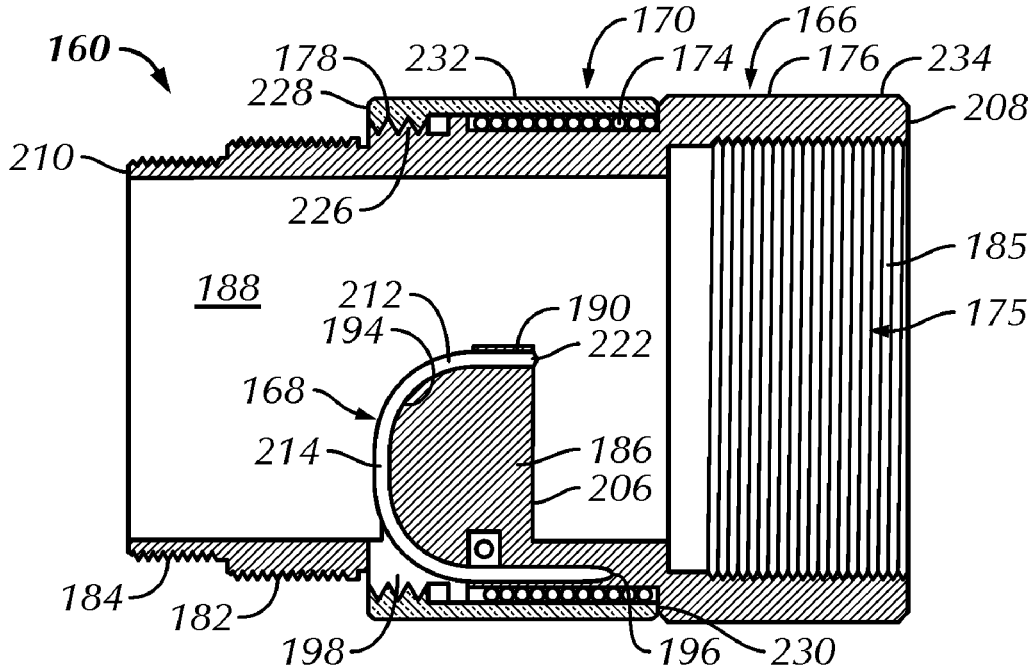
FIG. 12 is a sectional view of the sight taken along line 12-12 of FIG. 10.
Figure 11:
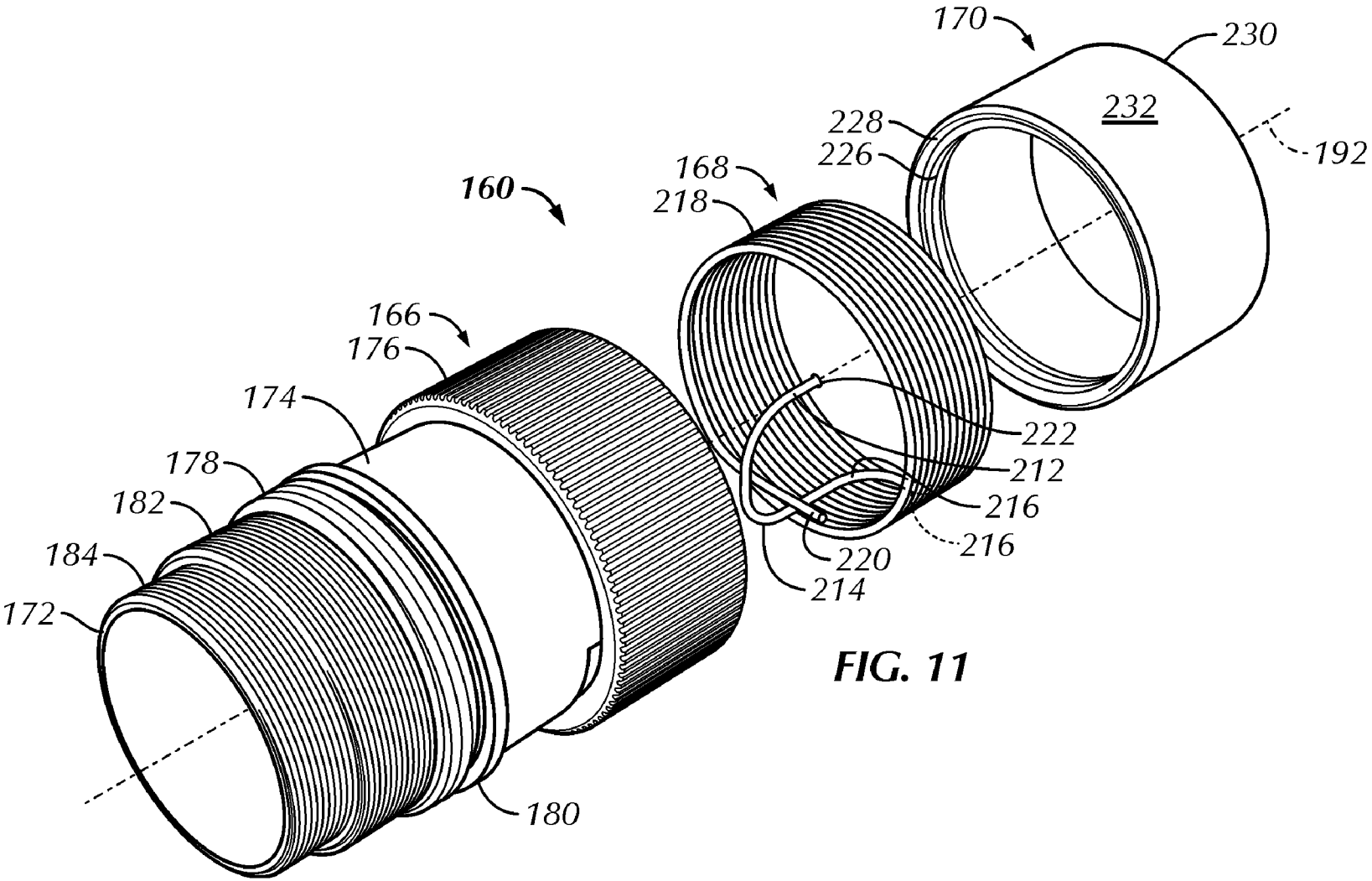
FIG. 11 is a front perspective exploded view of the sight of FIG. 10.

Referring now to FIGS. 10-12, an illuminated sight module 160 in accordance with a further embodiment of the invention is illustrated. The sight module 160 does not have a mounting base but is preferably part of other illuminated sight configurations, such as the illuminated sight 162 shown in FIGS. 14-15 and the illuminated sight 164 shown in FIGS. 16-17. The illuminated sight module 160 preferably includes a spool 166, a light collector 168 that wraps around the spool 166, and a protective cover 170 that encircles the light collector 168.

Figure 13:
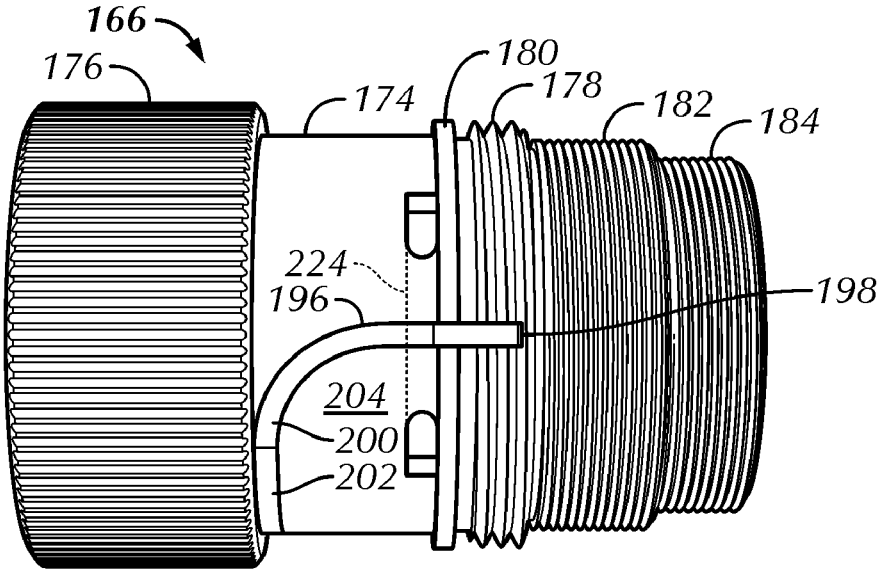
FIG. 13 is a bottom plan view of a spool that forms part of the sight of FIG. 9.

With additional reference to FIG. 13, the spool 166 is preferably of a tubular configuration and generally circular in cross section. The spool 166 has a continuous wall 172 that forms a sight window 175 through which a user can view a distal target. The spool 166 also includes an annular channel 174 formed in the wall 172, a knurled portion 176 located rearwardly of the channel and a ring 180 located forwardly of the channel. A first externally threaded portion 178 is located forwardly of the ring 180, a second externally threaded portion 182 is located forwardly of the first threaded portion 178, and a third externally threaded portion 184 is located forwardly of the second threaded portion 182. Preferably, the first threaded portion 178 has a larger diameter than the second threaded portion 182 and the second threaded portion 182 has a larger diameter than the third threaded portion 184. Internal threads 185 (FIG. 12) are formed in the spool 166 coincident with the knurled portion 176.

A sight post 186 (FIG. 12) projects radially inwardly from an inner surface 188 of the spool 166 and includes a bore 190 that is preferably coincident with a central axis 192 (FIG. 11) of the spool 166 and an arcuate portion 194 that extends from the bore 190 to a slot 196 (FIG. 13). As shown, the sight post 186 is oriented generally vertically. However, it will be understood that the sight post may have a horizontal orientation or any other angular orientation. An opening 198 extends through the first threaded portion 178 and is coincident with the slot 196 and arcuate portion 194. The slot 196 has a curved portion 200 that extends from the opening 198 and a ramped portion 202 that extends from the curved portion to the outer surface 204 of the annular channel 174 for guiding the light collector 168 from the bore 190 to the outer surface 204. Preferably, the rear face 206 of the sight post 186 is centrally located between the rear face 208 and front face 210 of the spool 166, and thus is centrally located with respect to the annular channel 174. As in the previous embodiments, the spool 166, sight post 186 and knurled portion 176 are constructed as a unitary structure through injection molding, machining or the like. However, it will be understood that these components may be formed separately and connected together through bonding, welding, press-fitting or other connecting means.

The light collector 168 is preferably similar in construction to the light collectors 18 and 118 previously described, and includes a straight or axially oriented section 212, a first transition or arcuate section 214 that extends from the axial section, a second transition or curved section 216 that extends from the arcuate section 214, a coiled section 218 that extends from the curved section 216, and an anchoring section 220 that extends from the coiled section 218.

The axial section 212 extends through the bore 190 of the sight post 186 and terminates in an enlarged sight point 222 that faces rearwardly for viewing by a user. The arcuate section 214 extends along the arcuate portion 194 of the sight post and through the opening 198. Preferably, the arcuate section 214 is located substantially forward of the coiled section 218 so that the curved section 216 can have a relatively large radius of curvature to substantially reduce or eliminate light loss through the curved section. The curved section 216 is positioned in the slot 196 and extends along the curved portion 200 and ramped portion 202 of the slot. The coiled section 218 wraps around the annular channel 174 of the spool 166 for a predetermined number of turns. The anchoring section 220 extends through a transverse bore 224 (shown in hidden line in FIG. 13) formed in the annular channel 174 and may be anchored to the spool by expanding the end of the anchoring section in a manner as previously described.

Each of the arcuate and curved sections 214, 216 of the light collector 168, and hence the arcuate, curved and ramped portions 194, 200 and 202 of the spool 166, preferably has a radius of curvature that is sufficiently large to eliminate or at least substantially reduce light loss from the light collector through the arcuate and curved sections, as previously described, so that the light collector 168 is more efficient in conducting the light received along its length to the sight point 222. Again, this arrangement is a great advantage over prior art solutions where a relatively tight bend is conducive to light loss, since the larger radius of curvature of the present invention will result in a much brighter sight point 222 than a smaller radius of curvature associated with a tight bend for the same length of fiber optic. In addition, by locating the sight point in a central portion of the spool 166, the sight point can more clearly be seen since it is shaded from ambient light and therefore will appear brighter.

Referring now to FIGS. 11 and 12, the protective cover 170 is preferably constructed of a transparent material and is generally circular in cross section to complement the shape of the annular channel 174. Internal threads 226 are formed at the forward end 228 of the spool for engaging the first threaded portion 178 of the spool 166. When installed, the rear end 230 preferably abuts the knurled portion 176 of the spool 166 and the outer surface 232 of the cover 170 is flush with the outer surface 234 of the knurled portion 176. The protective cover 170 is not intended to be a light blocking or light intensifying member, but only as a means of protecting the coiled section 218 against damage.

Although the protective cover 170 is shown as a separate transparent member, the cover can alternatively comprise tape, a coating or component that is directly applied or molded to the light collector 168 within the channel 174. Where the fiber optic is constructed of a sufficiently resistant material or where damage to the fiber optic is not a concern, the protective cover 170 can be eliminated.

Figure 14:
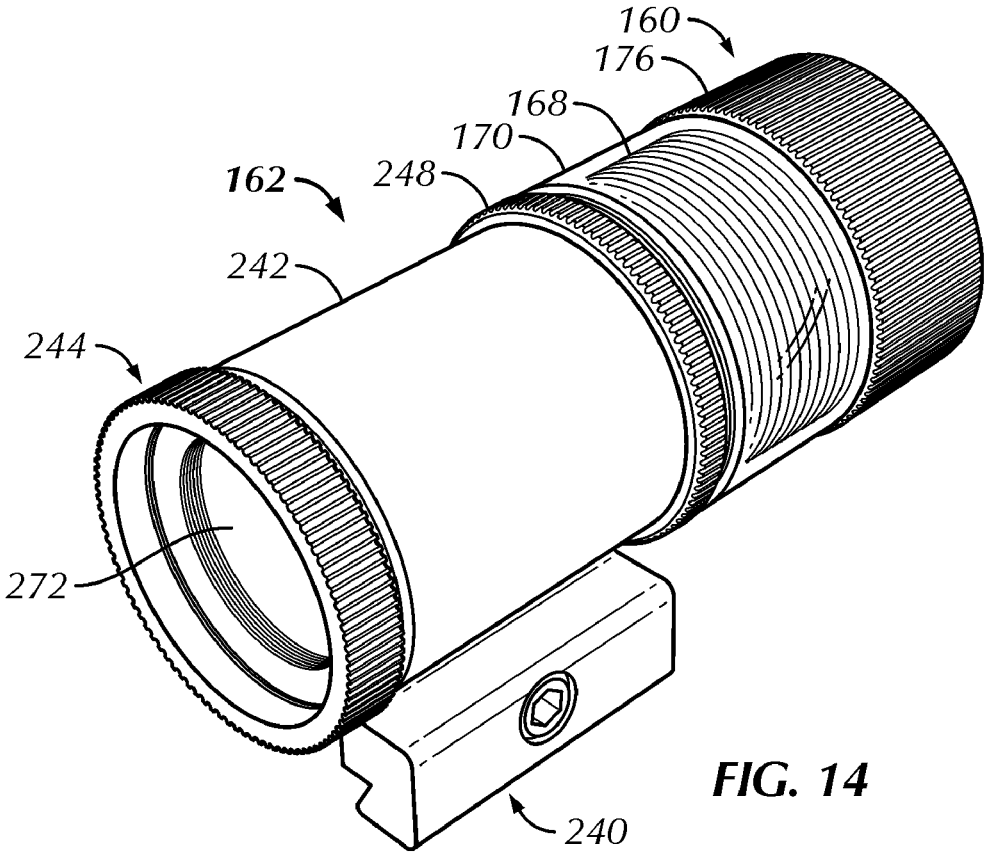
FIG. 14 is a front perspective view of an illuminated sight in accordance with a further embodiment of the invention.
Figure 15:
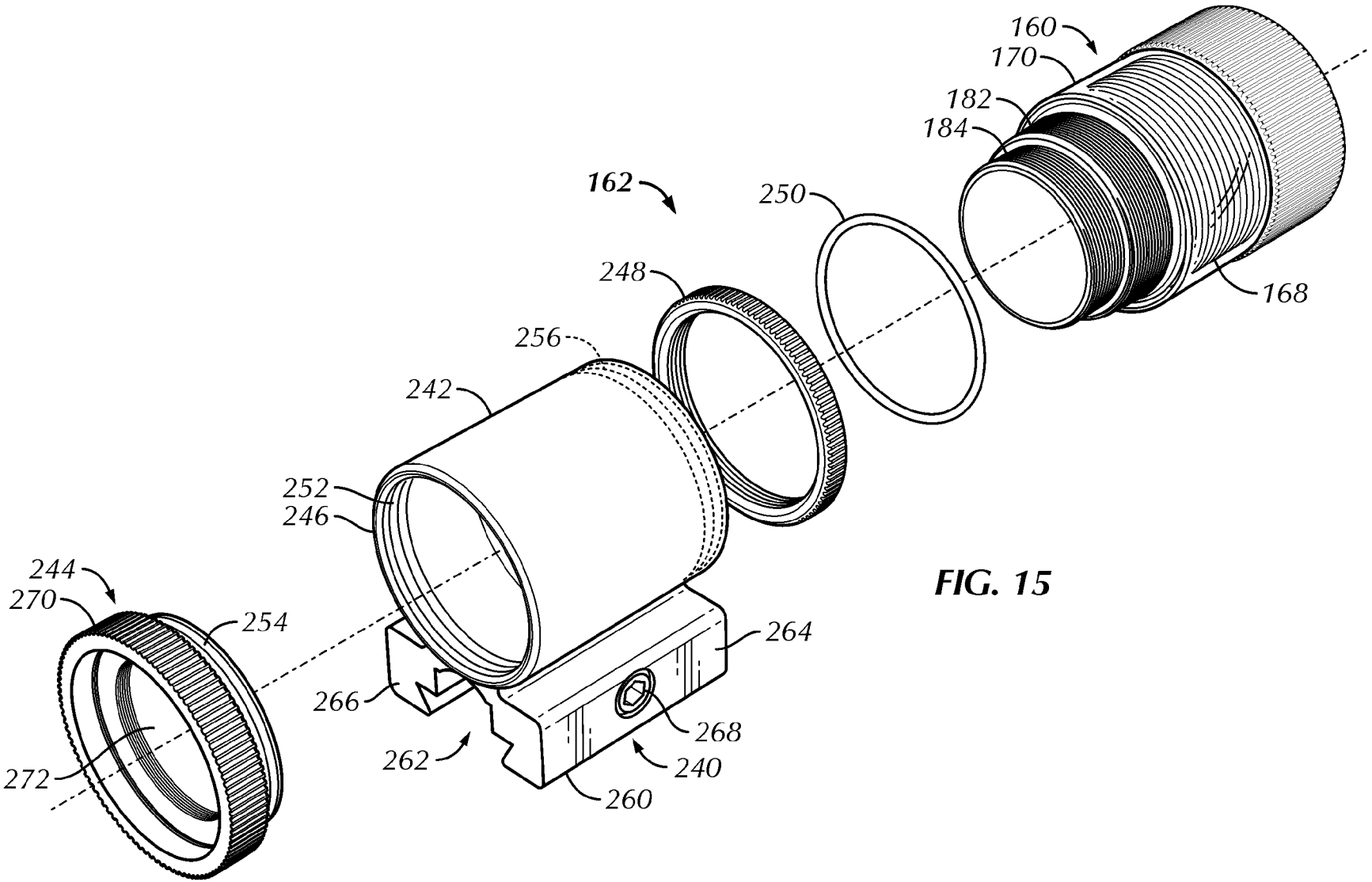
FIG. 15 is a front perspective exploded view of the sight of FIG. 14.

Referring now to FIGS. 14 and 15, an illuminated sight 162 in accordance with a further embodiment of the present invention is illustrated. The sight 162 incorporates the sight module 160 and further includes a mounting base 240 with an integral collar portion 242, a removable lens assembly 244 connected to a forward end 246 of the collar 242, a rearward locking ring 248 threaded onto the second threaded portion 182 of the sight module 160, and an O-ring 250 positioned between the locking ring 248 and the cover 170. The collar 242 has forward internal threads 252 that engage external threads 254 of the lens assembly 244 and rearward internal threads 256 (shown in hidden line) that engage the second threaded portion 182 of the sight module 160 when the sight module is screwed into the collar. When it is desired to orient the sight post to a particular angular orientation or cant, the locking ring 248 can be loosened and the sight module 160 rotated to the desired angular position. The locking ring can then be tightened to fix the sight module to the adjusted position.

The mounting base 240 preferably includes a bifurcated leg 260 with a dovetail-shaped slot 262 that extends longitudinally through the leg 260 to define leg portions 264, 266. The slot 262 is sized for receiving a complementary dovetail-shaped projection 38 (FIG. 1) associated with the barrel 40 of a firearm 12 or the like. A threaded bolt 268 extends through an opening (not shown) in the leg portion 264 and engages a threaded opening (not shown) in the leg portion 266 to pull the leg portions toward each other for securely mounting the base 240 to the firearm.

The removable lens assembly 244 has a knurled ring 270 with the external threads 254 and a lens 272 for augmenting or modifying a user's vision during aiming. A suitable lens 272 may have a particular filter color, magnification, aperture or iris size, cross hair, and so on, or combinations thereof, depending on the lighting conditions and user preferences. Accordingly, a plurality of interchangeable lenses or lens assemblies with different optical features may be provided.

Figure 16:
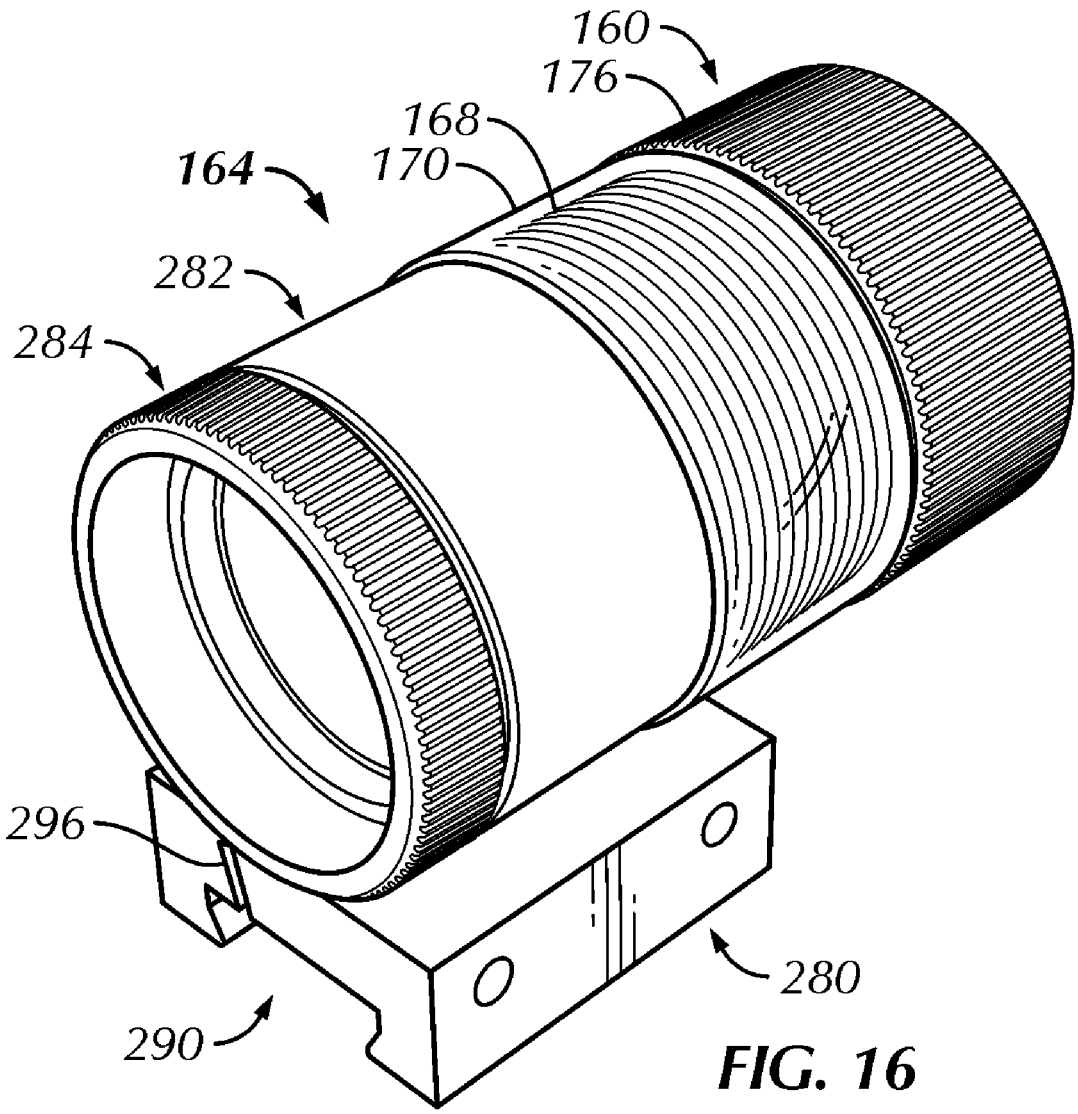
FIG. 16 is a front perspective view of an illuminated sight according to a further embodiment of the invention.
Figure 17:
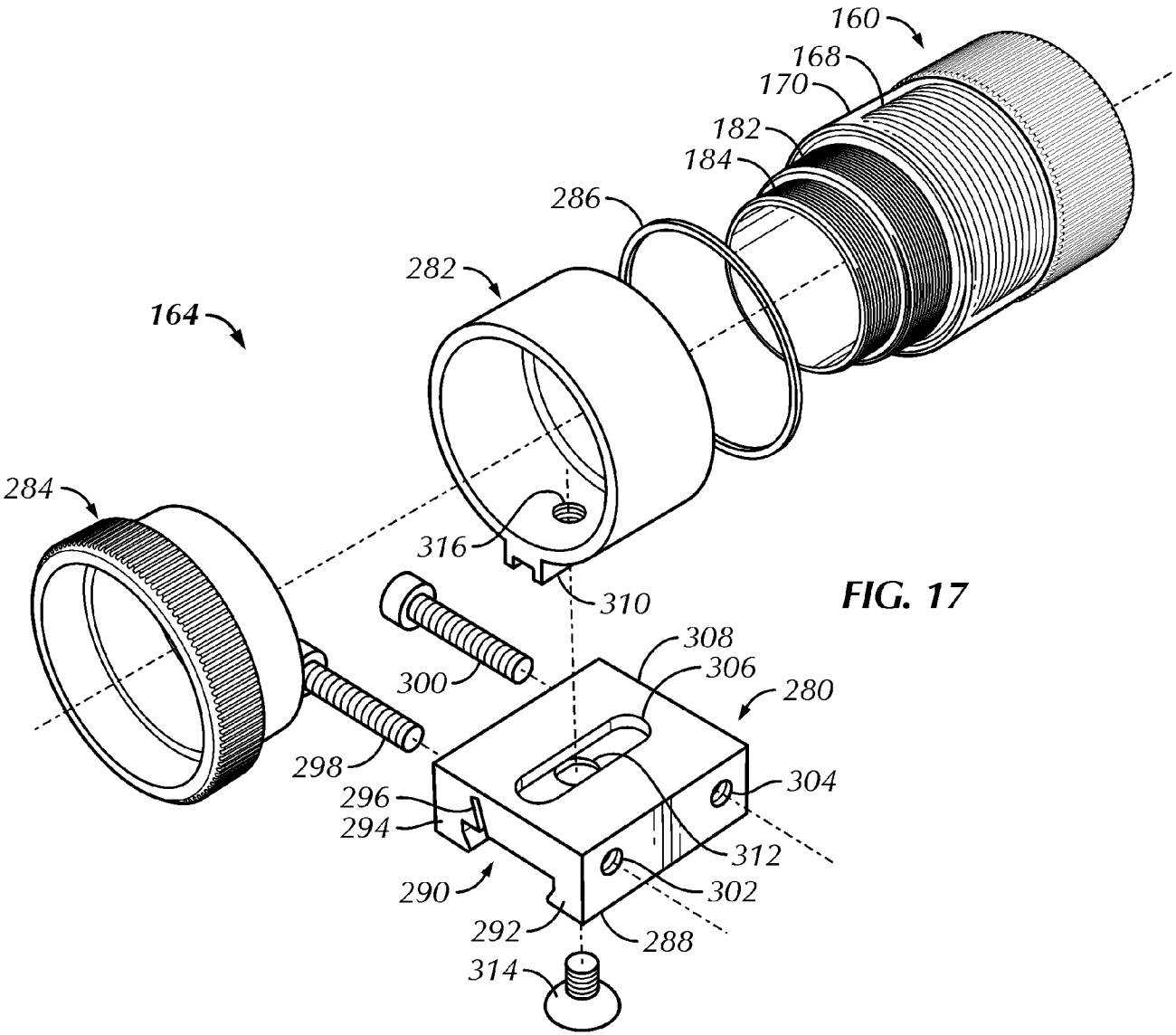
FIG. 17 is a front perspective exploded view of the sight of FIG. 16.
Figure 18:
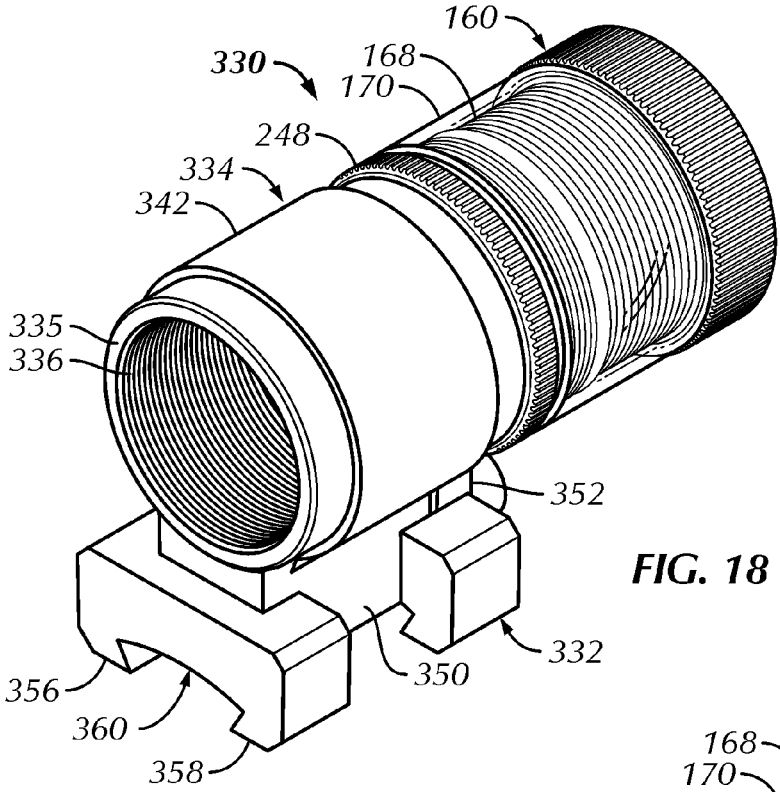
FIG. 18 is a front perspective view of an illuminated sight according to a further embodiment of the invention.
Figure 19:
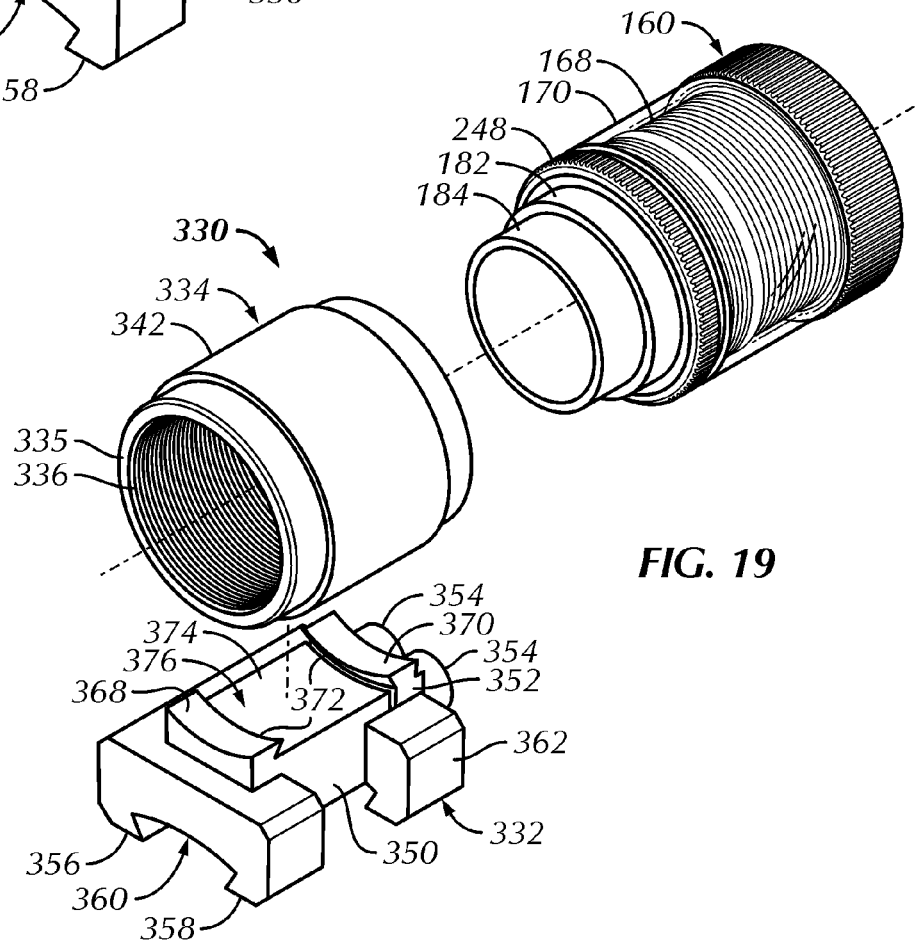
FIG. 19 is a front perspective exploded view of the sight of FIG. 18.

Referring now to FIGS. 16 and 17, an illuminated sight 164 in accordance with a further embodiment of the present invention is illustrated. The sight 164 incorporates the sight module 160 and further includes a mounting base 280, a mounting collar 282 connected to the mounting base, a forward knurled locking ring 284 with rearward internal threads (not shown) that engage the third threaded portion 184 of the sight module 160, and an O-ring 286 sandwiched between the mounting collar 282 and the cover 170.

The mounting base 280 includes a bifurcated leg 288 with a dovetail-shaped slot 290 that extends longitudinally through the leg 288 to define leg portions 292, 294. The slot 290 is sized for receiving a complementary dovetail-shaped projection 38 (FIG. 1) associated with the barrel 40 of a firearm 12 or the like. A groove 296 extends upwardly at an angle from the slot 290. A pair of threaded bolts 298, 300 extends through openings (not shown) in the leg portion 294 and engages threaded openings 302, 304 in the leg portion 292 to pull the leg portions toward each other for securely mounting the base 280 to the firearm. A longitudinal slot 306 is formed in an upper wall 308 of the base 280 and is sized for receiving a downward projection 310 of the mounting collar 282. A bolt 314 with a chamfered head extends through a chamfered opening 312 coincident with the slot 306 and engages a threaded opening 316 in the mounting collar 282 for securing the base and collar together.

As shown in FIGS. 18-21, an illuminated sight 330 in accordance with a further embodiment of the present invention is illustrated. The sight 330 incorporates the sight module 160 and further includes a mounting base 332, a mounting collar 334 connected to the mounting base, and a threaded locking ring 248 that engages the second threaded portion 182 of the sight module 160.

The mounting collar 334 includes a wall 335 with internal threads 336 that engage the external threads 182 of the sight module 160. Preferably, the internal threads 336 extend the entire length of the collar from a forward end 338 to a rearward end 340 thereof. An annular dovetail projection 342 extends around the wall 335 for engaging the mounting base 332.

Figure 20:
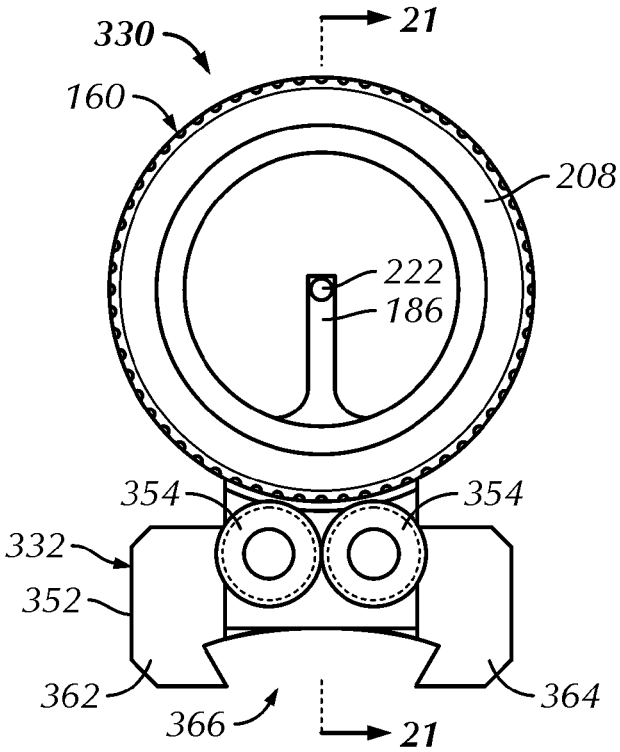
FIG. 20 is a rear elevational view of the sight of FIG. 18.
Figure 21:
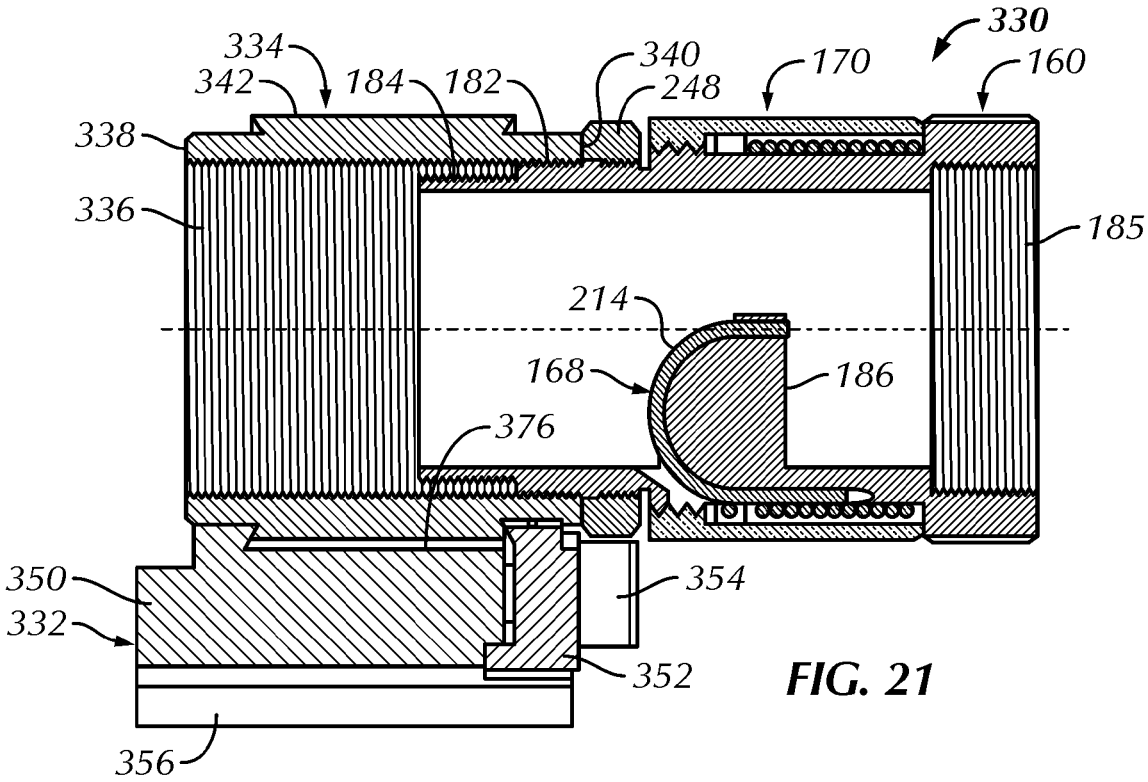
FIG. 21 is a sectional view taken along line 21-21 of FIG. 20.
Figure 22:
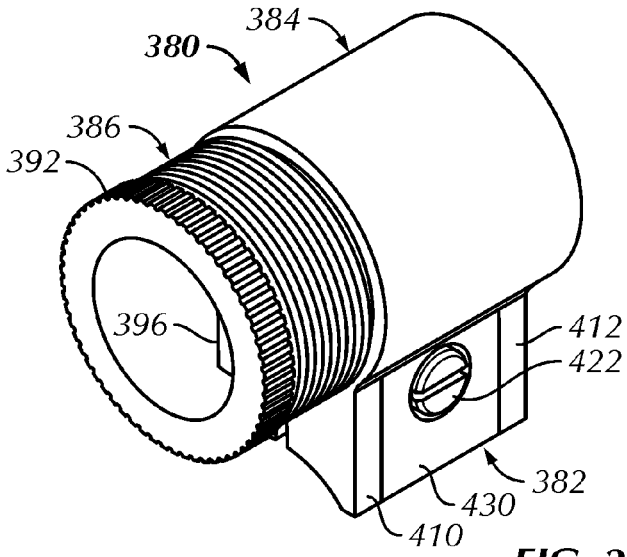
FIG. 22 is a rear perspective view of an illuminated sight according to a further embodiment of the invention.
Figure 23:
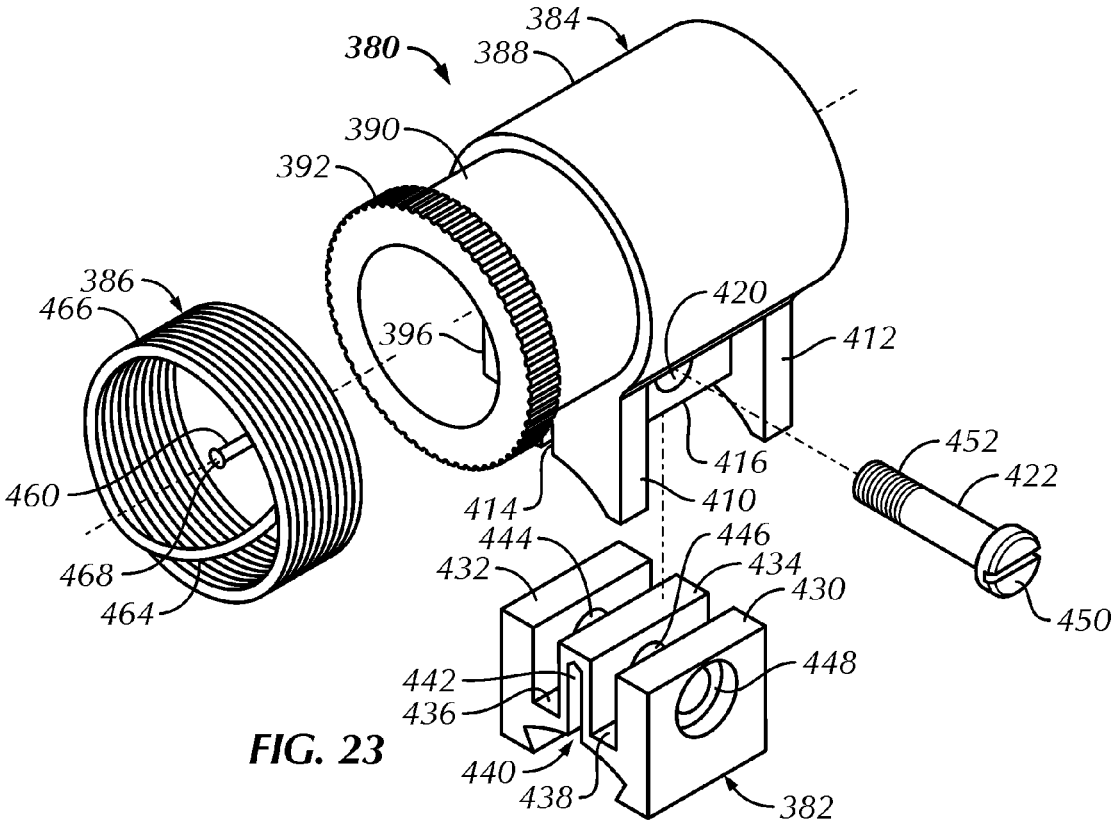
FIG. 23 is a rear perspective exploded view of the sight of FIG. 22.
Figure 24:
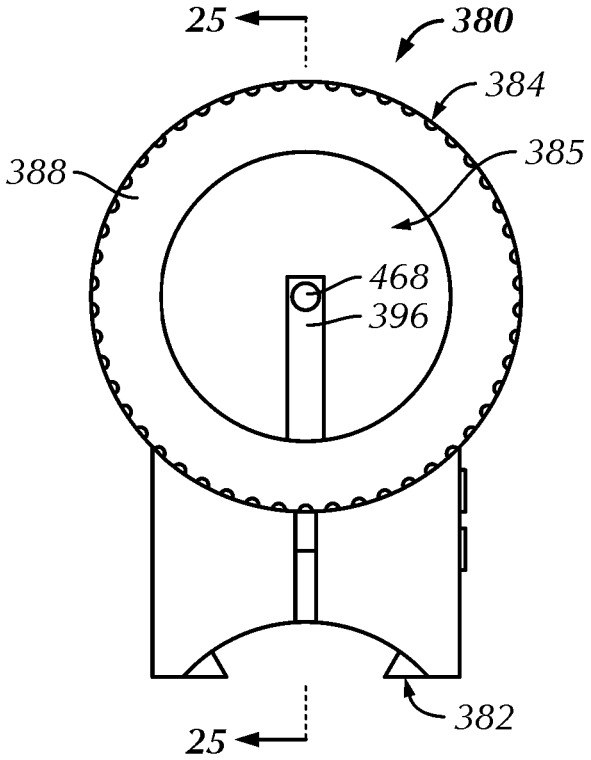
FIG. 24 is a rear elevational view of the sight of FIG. 22.
Figure 25:
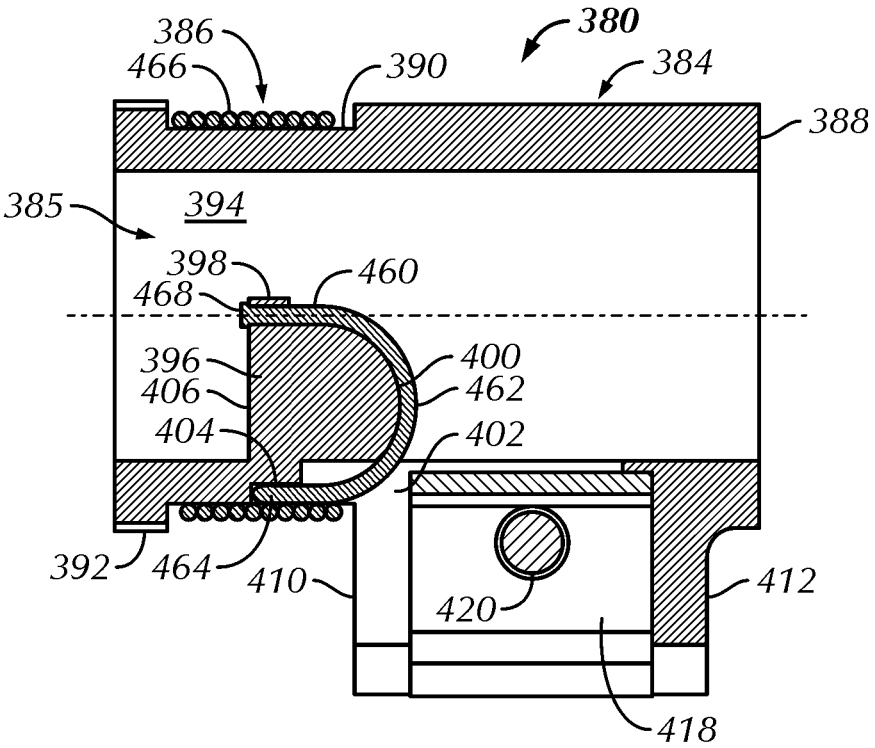
FIG. 25 is a sectional view taken along line 25-25 of FIG. 24.
Figure 26:
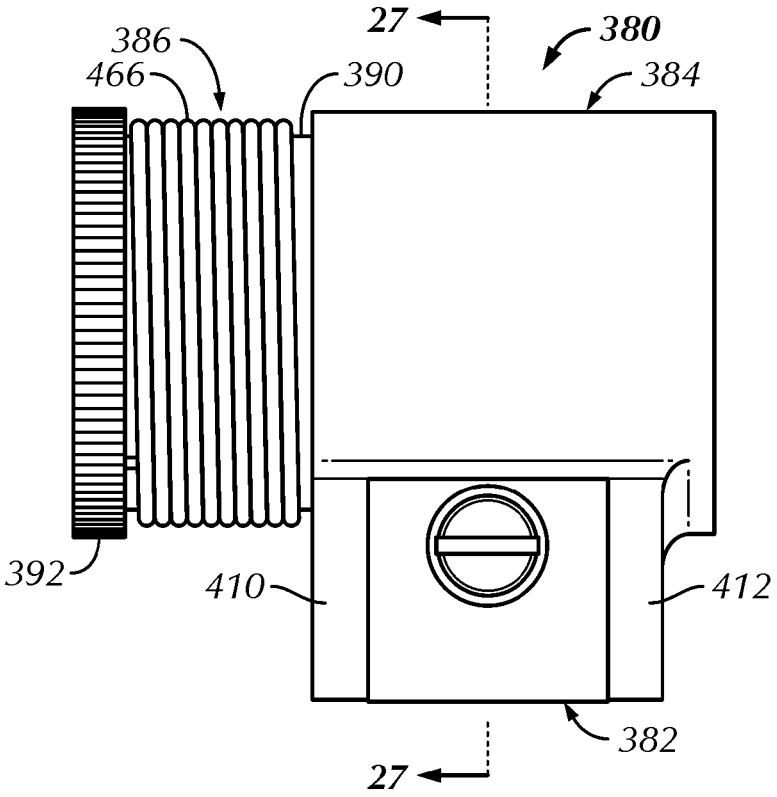
FIG. 26 is a side elevational view of the sight of FIG. 22.
Figure 27:
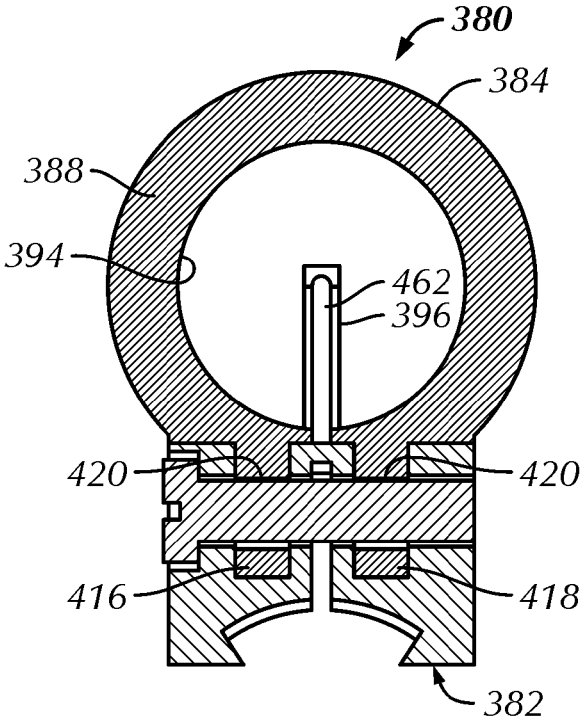
FIG. 27 is a sectional view taken along line 27-27 of FIG. 26.

The mounting base 332 includes a front base section 350, a rear base section 352, and a pair of threaded fasteners 354 that extend through the rear base section and thread into the front base section for holding the base sections together with the collar 334. The front base section 350 includes a front pair of downwardly projecting legs 356, 358 that are shaped to form a front dovetail-shaped slot 360 and a rear pair of downwardly projecting legs 362, 364 that are shaped to form a rear dovetail-shaped slot 366 (FIG. 20). The slots 360, 366 are sized for receiving a complementary dovetail-shaped projection of a projectile launching device. The front base section 350 also includes an upwardly projecting tab 368 while the rear base section 352 includes an upwardly projecting tab 370. Each tab 368, 370 has an angled surface 372 that faces an arcuate upper surface 374 of the front base section when the front and rear base sections are connected together. The angled surfaces 372 together with the upper surface 374 form an arcuate dovetail groove 376 that complements the shape of the annular dovetail projection 342.

During assembly, the fasteners 354 are loosened to separate the front and rear base sections. The annular dovetail projection 342 is then received into the arcuate dovetail groove 376 and the fasteners 354 are tightened to secure the collar to the front and rear base sections. The locking ring 248 is threaded onto the second threaded portion 182 and the sight module 160 is then screwed into the collar 334 with the second threaded portion 182 engaging the internal threads 336. Once the angular position of the sight post 186 is adjusted, the locking ring 248 is tightened against the rearward end 340 of the collar 334 to lock the sight module 160 to the collar. The angular position of the sight post may also or alternatively be adjusted by loosening the fasteners 354, rotating the collar 334 in the groove 376 until the sight post is at the desired angular orientation, then tightening the fasteners 354.

Referring now to FIGS. 22-27, an illuminated sight 380 in accordance with a further embodiment of the present invention is illustrated. The sight 380 preferably includes a mounting base 382, a spool 384 connected to the mounting base 382, and a light collector 386 that wraps around the spool 384.

The spool 384 is preferably of a tubular configuration with a continuous wall 388 that forms a sight window 385 through which a user can view a distal target. The spool 384 includes an annular channel 390, a knurled portion 392 located rearwardly of the channel and a sight post 396 that projects radially into the sight window 385 from an inner surface 394 of the spool 384. The sight post 396 includes a bore 398 that is preferably coincident with a central axis of the spool 384 and an arcuate portion 400 (FIG. 25) that extends from the bore 398 to an opening 402 in the spool. As shown, the sight post 396 is oriented generally vertically. However, it will be understood that the sight post may have a horizontal orientation or any other angular orientation. A slot 404 extends from the opening 402 to the channel 390 and, although not shown, is preferably similar in shape to the slot 196 of the FIG. 13 embodiment. Preferably, the rear face 406 of the sight post 396 is centrally located with respect to the annular channel 390.

Rear and front legs 410 and 412, respectively, extend downwardly from the spool 384. Preferably, a slot 414 is formed in the rear leg 410. Spaced ribs 416, 418 also extend downwardly from the spool 384 and between the front and rear legs. An opening 420 is formed in each rib 416, 418 for receiving a fastener 422 to secure the spool 384 to the mounting base 382, as will be explained in greater detail below.

As in the previous embodiments, the spool 384, sight post 396, knurled portion 392, rear and front legs 410, 412 and the spaced ribs 416, 418 are preferably constructed as a unitary structure through injection molding, machining or the like. However, it will be understood that these components may be formed separately and connected together through bonding, welding, press-fitting or other connecting means.

The mounting base 382 includes outer walls 430, 432 and an inner wall 434 connected to the outer walls 430, 432 via horizontal extensions 436 and 438, respectively. A lower end of the outer walls are preferably shaped to form a dovetail groove 440 while a slot 442 extends into the inner wall 434 from the dovetail groove 440. An opening 444, 446 and 448 is formed in each wall 432, 434 and 430, respectively, for receiving the fastener 422. Preferably, the opening 448 is countersunk for receiving the fastener head 450 and the opening 444 is threaded for engaging the threaded shaft 452 of the fastener.

In order to attach the spool 384 to the mounting base 382, the ribs 416, 418 of the spool are respectively guided between the walls 430, 434 and the walls 434 and 432 of the mounting base until the openings 420 in the ribs are aligned with the openings 444, 446 and 448 in the walls. The fastener 422 is then inserted through the openings and secured. As the fastener 422 is tightened, the slot 442 in the mounting base 382 will narrow so that the sight 380 can be secured to a dovetail protrusion of a projectile launching device.

The light collector 386 is preferably similar in construction to the light collector 168 (FIG. 11) previously described, and includes a straight or axially oriented section 460, a first transition or arcuate section 462 that extends from the axial section, a second transition or curved section 464 that extends from the arcuate section 462, and a coiled section 466 that extends from the curved section 464.

The axial section 460 extends through the bore 398 of the sight post 396 and terminates in an enlarged sight point 468 that faces rearwardly for viewing by a user. The arcuate section 462 extends along the arcuate portion 400 of the sight post and through the opening 402. Preferably, the arcuate section 462 is located forward of the coiled section 466 so that the curved section 464 can have a relatively large radius of curvature to substantially reduce or eliminate light loss through the curved section, as in the previous embodiments. The curved section 464 is positioned in the slot 404 while the coiled section 466 wraps around the annular channel 390 of the spool 384 for a predetermined number of turns. The end of the light collector 386 can be secured to the spool through heat forming, adhesive bonding, or any other well known attachment means.

Figure 28:
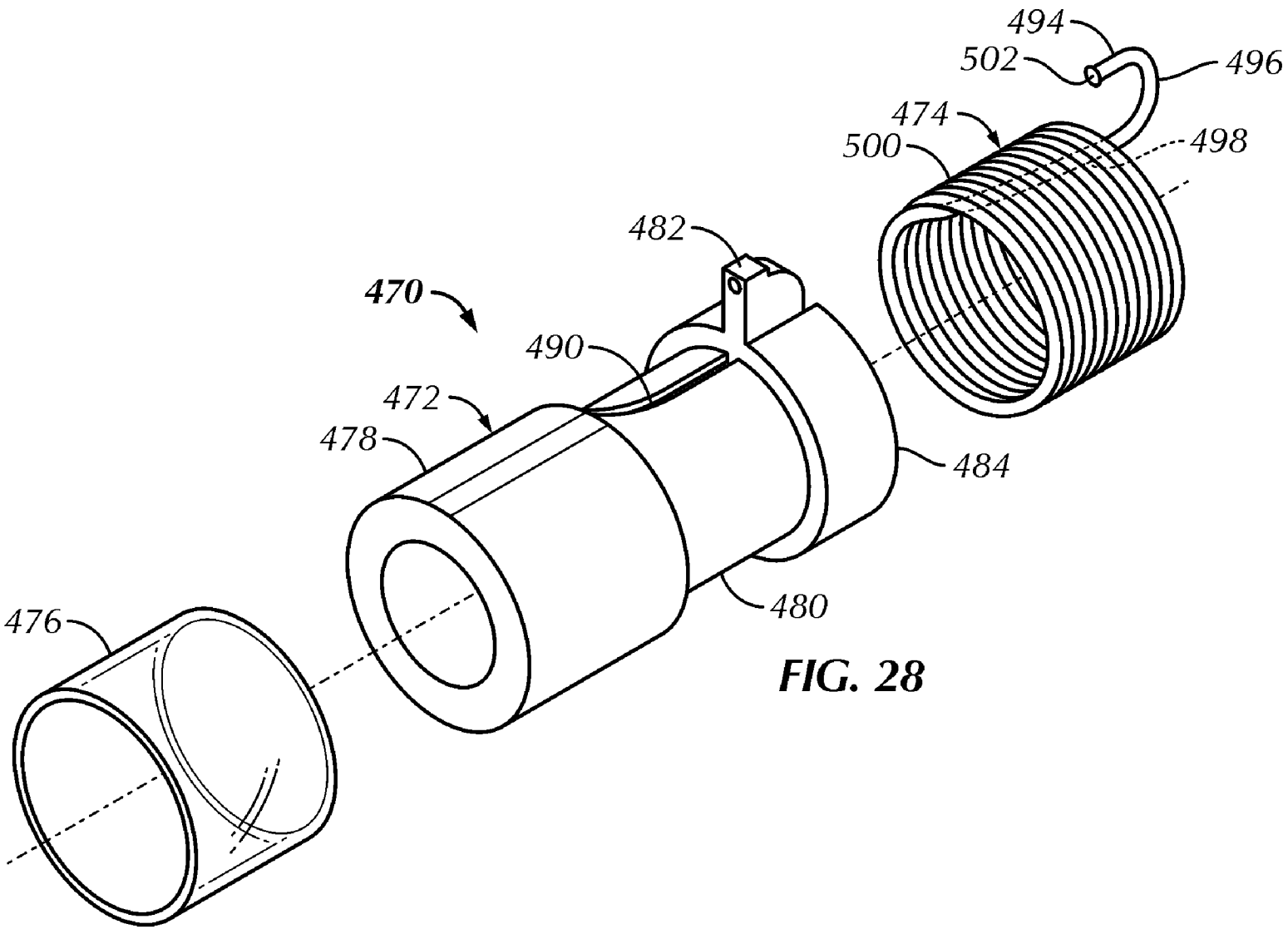
FIG. 28 is a rear perspective exploded view of an illuminated sight according to a further embodiment of the invention.
Figure 29:
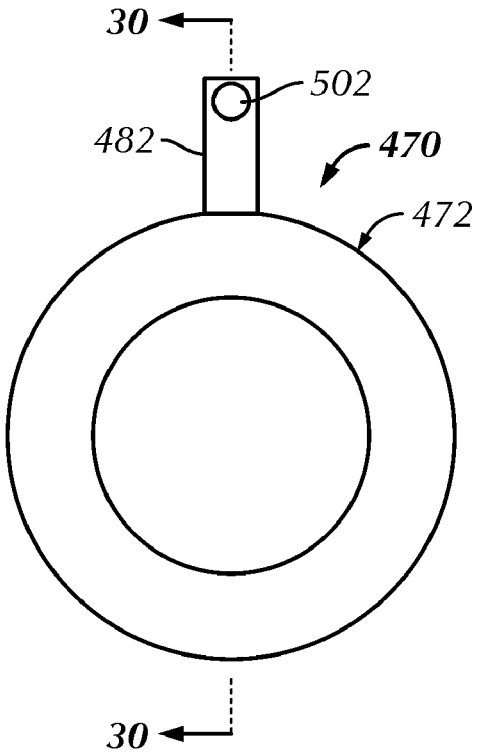
FIG. 29 is a rear elevational view of the sight of FIG. 28.
Figure 30:
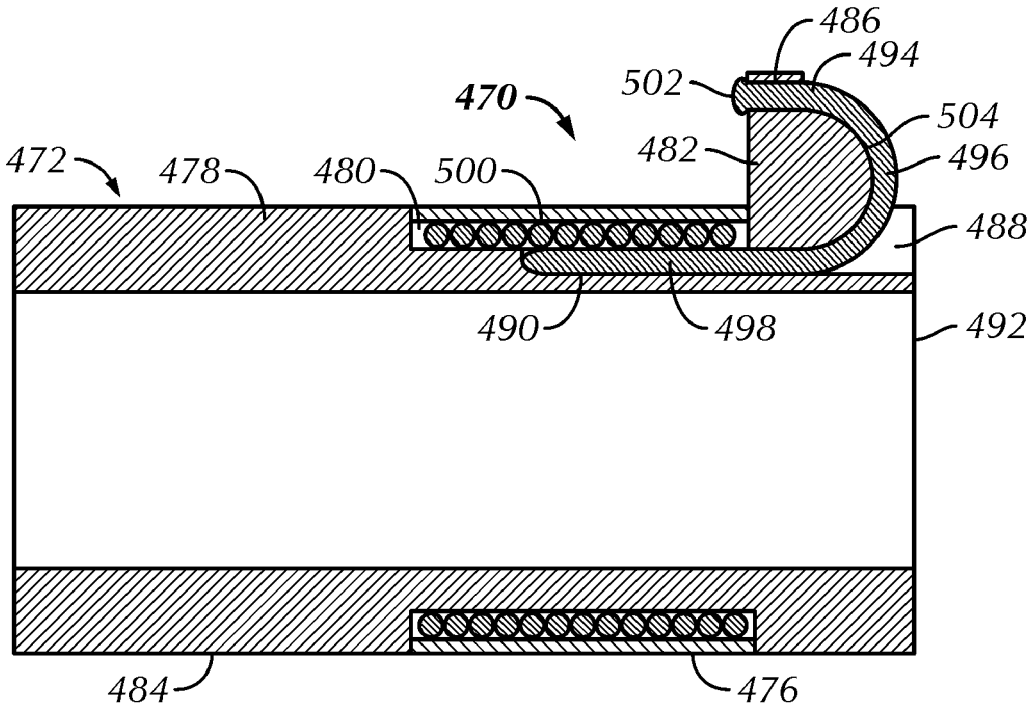
FIG. 30 is a sectional view taken along line 30-30 of FIG. 29.

Turning now to FIGS. 28-30, an illuminated sight 470 in accordance with a further embodiment of the invention is illustrated. The sight 470 preferably includes a spool 472, a light collector 474 mounted to the spool 472, and optionally a protective cover 476 extending over the light collector. Although a mounting base is not shown with the present embodiment, it will be understood that any of the previous mounting bases or other mounting means may be provided for attaching the sight 470 to a projectile launching device or the like.

The spool 472 has a continuous wall 478 with an annular channel 480. A sight post 482 preferably projects upwardly from an outer surface 484 of the spool 472 between the annular channel 480 and the front end 492 of the sight 470. It will be understood that the sight post 482 may be located at other positions along the length of the spool 472, such as the location shown in FIG. 31. The sight post 482 includes a bore 486 that is preferably parallel with a central axis of the spool. As shown, the sight post 482 is oriented generally vertically. However, it will be understood that the sight post may have a horizontal orientation or any other angular orientation. An opening 488 extends under the sight post 482 between the sight front end 492 and a curved slot or groove 490 formed in an outer surface of the annular channel 480. Preferably, the curved slot 490 is similar in shape to the curved slot 196 as shown in FIG. 13.

The light collector 474 is somewhat similar in construction to the light collector 168 (FIG. 11) previously described, and includes a straight or axially oriented section 494, a first transition or arcuate section 496 that extends from the axial section, a second transition or curved section 498 that extends from the arcuate section 496, and a coiled section 500 that extends from the curved section 498.

The axial section 494 of the light collector 474 extends through the bore 486 of the sight post 482 and terminates in an enlarged sight point 502 that faces rearwardly for viewing by a user. The arcuate section 496 extends along the arcuate portion 504 of the sight post and through the opening 488. Preferably, the arcuate section 496 is located forward of the coiled section 500 so that the curved section 498 can have a relatively large radius of curvature to substantially reduce or eliminate light loss through the curved section, as in the previous embodiments. The curved section 498 is positioned in the slot 490 while the coiled section 500 wraps around the annular channel 480 of the spool 472 for a predetermined number of turns. The end of the light collector 474 can be secured to the spool through any means previously described or solely by means of the protective cover 476. The protective cover 476 is preferably similar in construction to the cover 170 previously described and is preferably positioned in the annular channel 480 such that an outer surface 506 of the cover is flush with the outer surface 484 of the spool 472.

Figure 31:
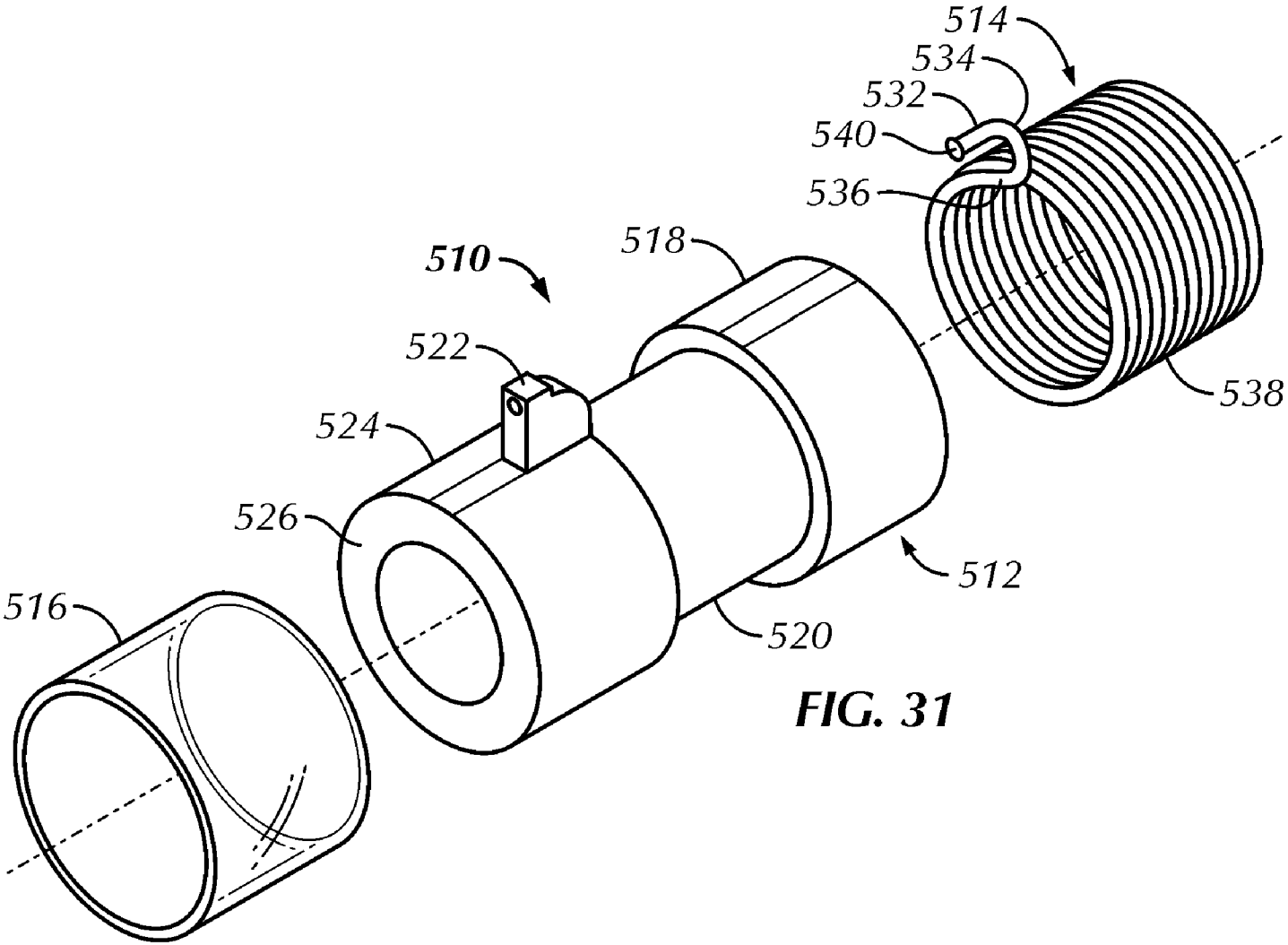
FIG. 31 is a rear perspective exploded view of an illuminated sight according to a further embodiment of the invention.
Figure 32:
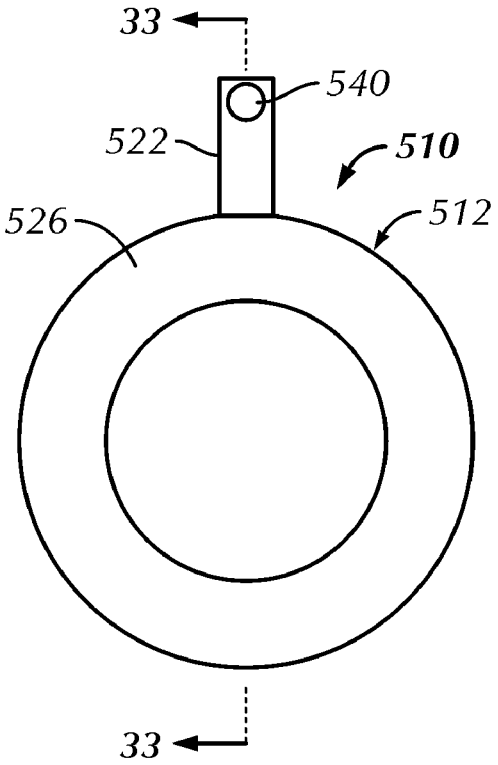
FIG. 32 is a rear elevational view of the sight of FIG. 31.
Figure 33:
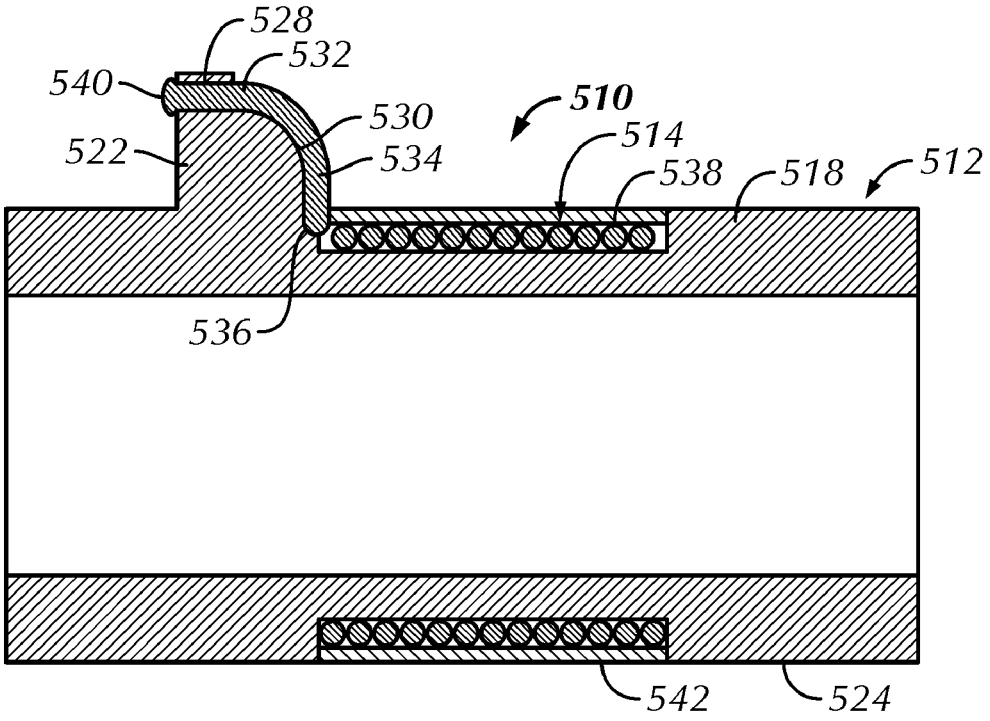
FIG. 33 is a sectional view taken along line 33-33 of FIG. 32.

Referring now to FIGS. 31-33, an illuminated sight 510 in accordance with a further embodiment of the invention is illustrated. The sight 510 preferably includes a spool 512, a light collector 514 mounted to the spool 512, and optionally a protective cover 516 extending over the light collector. Although a mounting base is not shown with the present embodiment, it will be understood that any of the previous mounting bases or other mounting means may be provided for attaching the sight 510 to a projectile launching device or the like.

The spool 512 has a continuous wall 518 with an annular channel 520. A sight post 522 preferably projects upwardly from an outer surface 524 of the spool 512 between the annular channel 520 and the rear end 526 of the sight 510. It will be understood that the sight post 522 may be located at other positions along the length of the spool 512, such as the location shown in FIG. 28. The sight post 522 includes a bore 528 that is preferably parallel with a central axis of the spool and an arcuate portion 530 that curves downwardly from the bore 528. As in the previous embodiment, the sight post 522 is preferably oriented generally vertically but may be oriented at any desired angle.

The light collector 514 includes a straight or axially oriented section 532, a first transition or arcuate section 534 that extends from the axial section, a second transition or curved section 536 that extends from the arcuate section 534, and a coiled section 538 that extends from the curved section 536.

The axial section 532 of the light collector 514 extends through the bore 528 of the sight post 522 and terminates in an enlarged sight point 540 that faces rearwardly for viewing by a user. The arcuate section 534 extends along the arcuate portion 530 of the sight post. The curved section 536 has a smaller radius than the previous embodiments so that the light collector 514 can be wrapped around the channel 520 immediately after the curved section. The protective cover 516 is preferably similar in construction to the cover 170 previously described and is preferably positioned in the annular channel 520 such that an outer surface 542 of the cover is flush with the outer surface 524 of the spool 512.

The embodiments shown in FIGS. 28-33 can be integrally molded or otherwise formed with the barrel of a firearm such that the spool itself forms a part of the barrel through which a projectile is launched. In this manner, the cost of the sight is significantly reduced and is lower in profile than the previous embodiments.

It will be understood that the term "preferably" as used throughout the specification refers to one or more exemplary embodiments of the invention and therefore is not to be interpreted in any limiting sense. In addition, terms of orientation and/or position as may be used throughout the specification, such as inward, inner, outer, forward, rearward, upward, downward, vertical, horizontal, as well as their respective derivatives and equivalent terms denote relative, rather than absolute orientations and/or positions.

It will be appreciated by those skilled in the art that changes could be made to the embodiments described above without departing from the broad inventive concept thereof. It will be understood, therefore, that this invention is not limited to the particular embodiments disclosed, but also covers modifications within the spirit and scope of the present invention as defined by the appended claims.

What is claimed is:

1. A sight for a firearm having a barrel, the sight comprising:

a spool;

a sight post extending from the spool;

a mounting base connected to the spool for connecting the sight to the barrel;

an elongate light collector having opposite ends, at least one end thereof connected to the sight post, the at least one end defining at least one rearwardly facing sight point for viewing by a user, the light collector being formed such that light can be gathered along its length and transmitted to the at least one end;

the light collector further comprising:

an axial section extending from the sight point and connected to the sight post;

a curved transition section optically coupled with the axial section, the curved transition section having a radius of curvature that is sufficiently large to substantially reduce or eliminate light loss from the light collector and thereby increase a brightness of the sight point; and a coiled section extending from the curved section and spiraling around the spool.

2. A sight according to claim 1, wherein the spool has an outer surface with an annular channel formed therein, the coiled section of the elongate light collector being positioned within the annular channel.

3. A sight according to claim 2, wherein the annular channel comprises a groove with a curved portion for receiving the curved section of the light collector.

4. A sight according to claim 1, wherein the sight point is positioned rearwardly of the coiled section.

5. A sight according to claim 4, wherein the light collector further comprises a ramped section extending between the axial section and the curved transition section, at least a substantial portion of the ramped section being located rearwardly of the coiled section.

6. A sight according to claim 5, wherein the light collector further comprises an arcuate section extending between the axial section and the curved transition section, at least a substantial portion of the arcuate section being located forwardly of the coiled section.

7. A sight according to claim 6, wherein the sight point is centrally located in the coiled section.

8. A sight according to claim 7, wherein the spool is rotatable to adjust an angular orientation of the sight post.

9. A sight according to claim 1, wherein the mounting base comprises at least one collar portion for receiving the spool.

10. A sight according to claim 9, wherein the spool comprises at least one externally threaded portion for engaging internal threads of the at least one collar portion.

11. A sight according to claim 10, and wherein the spool comprises a further externally threaded portion, and further comprising a locking ring with internal threads for engaging the further externally threaded portion, the locking ring being adapted to abut the at least one collar portion for locking the spool and thus the sight post in a particular angular orientation.

12. A sight according to claim 11, and further comprising a lens assembly connected to the at least one collar portion opposite the spool.

13. A sight for a projectile launching device, the sight comprising:

a spool;

a sight post extending from the spool;

an elongate light collector having opposite ends, at least one end thereof connected to the sight post, the at least one end defining at least one rearwardly facing sight point for viewing by a user, the light collector being formed such that light can be gathered along its length and transmitted to the at least one end;

the light collector further comprising:

a curved transition section optically coupled with the rearwardly facing sight point, the curved transition section having a radius of curvature that is sufficiently large to substantially reduce or eliminate light loss from the light collector and thereby increase a brightness of the sight point; and a coiled section extending from the curved section and spiraling around the spool.

14. A sight according to claim 13, wherein the spool has a continuous wall that defines a sight window, the sight post extending into the sight window.

15. A sight according to claim 13, wherein the light collector further comprises an axial section extending between the sight point and the curved transition section.

16. A sight according to claim 13, wherein the spool has an outer surface with an annular channel formed therein, the coiled section of the elongate light collector being positioned within the annular channel.

17. A sight according to claim 13, and further comprising a mounting base connected to the spool for connecting the sight to the projectile launching device.

18. A sight according to claim 17, wherein the mounting base comprises at least one collar portion for receiving the spool.

19. A sight according to claim 18, wherein the spool comprises at least one externally threaded portion for engaging internal threads of the at least one collar portion.

20. A sight according to claim 19, wherein the spool comprises a further externally threaded portion for engaging one of the at least one collar portion and a locking ring.

21. A sight according to claim 20, and further comprising a locking ring with internal threads for engaging the further externally threaded portion, the locking ring being adapted to abut the at least one collar portion for locking the spool and thus the sight post in a particular angular orientation.

22. A sight according to claim 20, wherein the one externally threaded portion is greater in diameter than the further externally threaded portion.

23. A sight according to claim 18, and further comprising a mounting ring with internal threads positioned forwardly of the collar, the spool extending forwardly through the collar and having at least one exposed externally threaded portion for engaging the internal threads of the mounting ring.

* * * * *

UNITED STATES PATENT AND TRADEMARK OFFICE
Certificate

Patent No. 7,739,825 B2

Patented: June 22, 2010

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Paul LoRocco, Dallas, TX (US) and John Estridge, Plano, TX (US).

Signed and Sealed this Seventeenth Day of June 2014.

MICHAEL J. CARONE
*Supervisory Patent Examiner*
Art Unit 3641
Technology Center 3600